US005601964A

United States Patent [19]

Yagihara et al.

[11] Patent Number: 5,601,964

[45] Date of Patent: *Feb. 11, 1997

[54] SILVER HALIDE PHOTOGRAPHIC MATERIALS

[75] Inventors: Morio Yagihara; Hisashi Okada, both of Kanagawa, Japan

[73] Assignee: Fuji Photo Film Co., Ltd., Kanagawa, Japan

[ * ] Notice: The portion of the term of this patent subsequent to Nov. 20, 2007, has been disclaimed.

[21] Appl. No.: 219,404

[22] Filed: Mar. 28, 1994

Related U.S. Application Data

[63] Continuation of Ser. No. 946,796, Sep. 18, 1992, which is a continuation of Ser. No. 666,443, Mar. 11, 1991, which is a continuation of Ser. No. 168,116, Mar. 14, 1988.

[30] Foreign Application Priority Data

Mar. 13, 1987 [JP] Japan ..... 62-58513

[51] Int. Cl.[6] ..... G03C 1/06

[52] U.S. Cl. ..... 430/264; 430/598; 430/599; 430/610

[58] Field of Search ..... 430/264, 598, 430/599, 610

[56] References Cited

U.S. PATENT DOCUMENTS

| | | | |
|---|---|---|---|
| 4,245,037 | 1/1981 | Tsujino et al. | 430/598 |
| 4,332,878 | 6/1982 | Akimura et al. | 430/264 |
| 4,478,928 | 10/1984 | Hess et al. | 430/598 |
| 4,550,070 | 10/1985 | Miyasaka et al. | 430/598 |
| 4,971,890 | 11/1990 | Okada et al. | 430/264 |
| 4,988,604 | 1/1991 | Machonkin et al. | 430/264 |
| 4,994,365 | 2/1991 | Looker et al. | 430/598 |
| 5,006,445 | 4/1991 | Yagihara et al. | 430/264 |
| 5,041,355 | 8/1991 | Machonkin et al. | 430/264 |

FOREIGN PATENT DOCUMENTS

| | | |
|---|---|---|
| 0143436 | 6/1985 | European Pat. Off. . |
| 0217260 | 4/1987 | European Pat. Off. . |
| 3203554 | 10/1982 | Germany . |
| 3710625 | 10/1987 | Germany . |
| 62-25745 | 2/1987 | Japan . |
| 2038012 | 7/1980 | United Kingdom . |
| 2039377 | 8/1980 | United Kingdom . |
| 2054880 | 2/1981 | United Kingdom . |

OTHER PUBLICATIONS

Patent Abstracts of Japan, vol. 11, No. 395 (P–650) [2842], Dec. 24, 1987, & JPA 62 160438.

*Primary Examiner*—Thorl Chea

*Attorney, Agent, or Firm*—Sughrue, Mion, Zinn, Macpeak & Seas

[57] ABSTRACT

A silver halide photographic material is disclosed, which comprises a support and at least one light-sensitive silver halide emulsion layer formed thereon, said emulsion layer containing at least one nucleating agent represented by formula (I)

$$R_1-SO_2NH-Y-\overset{A_1}{\overset{|}{N}}-\overset{A_2}{\overset{|}{N}}-G-R_2 \qquad (I)$$

wherein $A_1$ and $A_2$ both represent a hydrogen atom, or one of $A_1$ and $A_2$ represents a hydrogen atom and the other represents a sulfinic acid residue or an acyl group; $R_1$ represents an aliphatic group, an aromatic group, or a heterocyclic group; $R_2$ represents a hydrogen atom, an alkyl group, an aryl group, an alkoxy group, an aryloxy group, or an amino group; G represents a carbonyl group, a sulfonyl group, a sulfoxy group, a phosphoryl group, or an iminomethylene group; and Y represents a phenylene group or a naphthylene group; the sum of the total carbon atoms of said $R_1$, $R_2$, and Y being at least 13. The nucleating agent provides very high contrast images when used in a negative working silver halide emulsion.

15 Claims, No Drawings

SILVER HALIDE PHOTOGRAPHIC MATERIALS

This is a continuation of application No. 07/946,796 filed Sep. 18, 1992, which is a continuation of application of 07/666,443 filed Mar. 11, 1991, which is a continuation of application No. 07/168,116 filed Mar. 14, 1988.

FIELD OF THE INVENTION

This invention relates to a silver halide photographic material giving very high contrast negative images, high sensitive negative images and good dot image quality or to a silver halide photographic material forming direct positive photographic images. More particularly, the invention relates to a photographic light-sensitive material containing a novel compound as a nucleating agent for silver halide.

BACKGROUND OF THE INVENTION

It is known to add hydrazine compounds to silver halide photographic emulsions or developers. For example, a developer containing ascorbic acid and hydrazine is described in U.S. Pat. No. 3,730,727, the use of hydrazine as an auxiliary developing agent for obtaining direct positive color images is described in U.S. Pat. No. 3,227,552, a silver halide photographic material containing β-monophenylhydrazide of an aliphatic carboxylic acid as a stabilizer thereof is described in U.S. Pat. No. 3,386,831, and other photographic techniques using hydrazine compounds are also described in U.S. Pat. No. 2,419,975 and Mees, The Theory of Photographic Process, 3rd edition, 281 (1966).

In particular, aforesaid U.S. Pat. No. 2,419,975 discloses that high contrast negative images can be obtained by the addition of hydrazine compounds. That is, it is described in the aforesaid patent that when a hydrazine compound is added to a silver chlorobromide emulsion and the emulsion is developed by a developer having high pH of 12.8, a very high contrast photographic property of over 10 in gamma (γ) is obtained. However, such a high alkaline developer of pH near 13 is liable to be air-oxidized and thus is unstable, whereby the developer can not endure the storage or use thereof for a long period of time.

The high contrast photographic property of over 10 in gamma is very useful for the photographic reproduction of continuous tone images by dot images useful for making printing plate or the reproduction of line images. For such a purpose, a process of using a silver chlorobromide emulsion containing more than 50 mol %, preferably more than 75 mol % silver chloride and developing the emulsion layer with a hydroquinone developer having very low effective concentration of sulfite ion (usually lower than about 0.1 mol/liter) has been generally used. However, since in the process the sulfite ion concentration in the developer is low, the developer is very unstable and can not endure the storage over 3 days.

Furthermore, since the aforesaid process uses a silver chlorobromide emulsion having a relatively high content of silver chloride, a high sensitivity cannot be obtained. Accordingly, it has strongly been desired to obtain very high contrast photographic characteristics useful for the reproduction of dot images or line images using high-speed silver halide emulsions and a stable developer.

The inventors previously proposed silver halide photographic emulsions giving very high contrast negative gradation photographic characteristics using stable developers in U.S. Pat. Nos. 4,224,401, 4,168,977, 4,243,739, 4,272,614, and 4,323,643 but have found that the acylhydrazine compounds disclosed in the patents have the following disadvantage.

That is, it is known that these hydrazines disclosed therein generate nitrogen gases during processing, these gases gather to form bubbles in the photographic material containing the compounds to spoil the photographic images formed, and further the compounds come out in a processing solution, which give bad influences on other photographic materials.

Also, these conventional hydrazines give greatly high contrast but at the same time cause undesirable phenomenon called as "black pepper" by infectious development, which is a large problem in photo-engraving process. The black pepper is black spots formed at the places to become undeveloped portions among, for example, dots. The occurrence of the black pepper increases when the photographic light-sensitive materials are stored for a long period of time at, in particular, high temperature and high humidity and also increases by the reduction of sulfite ions, which are generally used as preservatives, or by the increase of the pH value of a processing solution caused by the fatigue of the processing solution with the passage of time, which results in greatly reducing the commercial value of the photographic light-sensitive materials for photo-engraving.

Accordingly, for preventing the occurrence of the black pepper, various efforts have been made by the attempts for preventing the occurrence of black pepper are frequently accompanied by reduction of sensitivity and gamma. Thus, silver halide photographic materials giving less black peppers without the reduction in sensitivity and contrast have been desired.

Furthermore, in the case of these conventional hydrazines, a large amount thereof must be used for sufficiently increasing the sensitivity and contrast of the photographic light-sensitive materials and further when these hydrazines are used in combination with other sensitizing technique (e.g., a means of enhancing chemical sensitization, a means of increasing silver halide grain sizes, or a means of adding a compound capable of accelerating sensitization as described in U.S. Pat. Nos. 4,272,606 and 4,241,164) in the case of requiring a particularly high speed for photographic light-sensitive materials, the photographic materials undergo sensitization and fogging with the passage of time during storage thereof.

Accordingly, compounds which are freed from the generation of bubbles and coming out in processing solution as described above, give no problem on the stability of the photographic materials with the passage of time, and can provide very high contrast photographic characteristics with the addition of a very small amount thereof have been desired.

Also, it is described in U.S. Pat. Nos. 4,385,108 and 4,269,929 that very high contrast negative gradation photographic characteristics are obtained by using hydrazines having a substituent liable to adsorb on silver halide grains but the hydrazine compounds practically described in the examples of the aforesaid patents have a problem of causing desensitization with the passage of time during storage of the photographic light-sensitive materials containing them. Therefore, it is necessary to select compounds which do not cause the aforesaid problem.

On the other hand, there are various kinds of direct positive photographic processes and in these processes, a process comprising light-exposing photographic materials containing silver halide grains previously fogged and then developing the photographic materials in the presence of a desensitizer, and a process comprising light-exposing photographic materials having silver halide emulsion layer(s) having sensitivity specks mainly in the insides of the silver halide grains and developing the materials in the presence of a nucleating agent are most useful. The present invention relates to the latter type process.

A silver halide emulsion having sensitive specks mainly in the insides of the silver halide grains thereof and forming latent images mainly in the insides of the silver halide grains is called internal latent image type silver halide emulsion, which is distinguished from a silver halide emulsion forming latent images mainly on the surfaces of the silver halide grains thereof.

Processes of obtaining direct positive images by surface-developing the internal latent image-type silver halide photographic emulsions in the presence of a nucleating agent and photographic emulsions or photographic light-sensitive materials which are used in such processes are described, for example, in U.S. Pat. Nos. 2,456,953, 2,497,875, 2,497,876, 2,588,982, 2,592,250, 2,675,318, 3,227,552, 3,317,322, British Patents 1,011,062, 1,151,363, 1,269,640, 2,011,391, Japanese Patent Publication Nos. 29405/68, 38164/74, Japanese Patent Application (OPI) Nos. 16623/78, 137133/78, 37732/79, 40629/79, 74536/79, 74729/79, 52055/80, and 90940/80 (the term "OPI" as used herein indicates an "unexamined published application").

In the aforesaid process of obtaining direct positive images, the nucleating agent may be added to a developer but when the nucleating agent is added to the silver halide photographic emulsion layer(s) or other proper layer(s) of photographic light-sensitive materials to adsorb it on the surface of silver halide grains, better reversal characteristics can be obtained.

As the nucleating agent which is used for the aforesaid process of obtaining direct positive images, there are hydrazines described in U.S. Pat. Nos. 2,563,785 and 2,588,982, hydrazine and hydrazine series compounds described in U.S. Pat. No. 3,227,552, heterocyclic quaternary salt compounds described in U.S. Pat. Nos. 3,615,615, 3,719,494, 3,734,738, 4,094,683 and 4,115,122, British Patent 1,283,835, Japanese Patent Application (OPI) Nos. 3426/77 and 69613/77, thiourea combined type acylphenylhydrazine series compounds described in U.S. Pat. Nos. 4,030,925, 4,031,127, 4,139,387, 4,245,037, 4,255,511 and 4,276,364, and British Patent 2,012,443, compounds having a heterocyclic thioamide as adsorptive group described in U.S. Pat. No. 4,080,207, phenylacylhydrazine compounds including a heterocyclic group having a mercapto group as adsorptive group described in British Patent 2,011,397B, sensitizing dyes having a substituent showing a nucleating action in the molecular structure described in U.S. Pat. No. 3,718,470, and hydrazine compounds described in Japanese Patent Application (OPI) Nos. 200230/84, 212828/84 and 212829/84 and *Research Disclosure,* No. 23510 (November, 1983).

However, these compounds have such disadvantages that they are insufficient in activity as nucleating agent or some of those having high activity as nucleating agent are insufficient in storage stability, the activity thereof varies even before coating a silver halide emulsion to which the compound has been added, and further when a large amount of the compound is added to a silver halide emulsion, the layer quality of the emulsion layer is reduced.

SUMMARY OF THE INVENTION

A first object of this invention is, therefore, to provide a silver halide photographic material capable of giving very high contrast negative gradation photographic characteristics over 10 in gamma using a stable developer.

A second object of this invention is to provide a negative working silver halide photographic material containing an acylhydrazine capable of giving very high contrast negative gradation photographic characteristics with a small addition amount thereof without bad influences on the photographic performance.

A third object of this invention is to provide a direct positive type silver halide photographic material containing a high-active nucleating agent.

A fourth object of this invention is to provide a silver halide photographic material containing a hydrazine, which can be easily synthesized, shows less variation of the activity in the production of the silver halide photographic material, is excellent in storage stability, and does not deteriorate the layer quality in the case of adding a large amount thereof, the photographic material being excellent in stability with the passage of time.

A fifth object of this invention is to provide a silver halide photographic material showing high contrast photographic characteristics and forming less black pepper.

It is now been discovered that the above-described objects of this invention can be attained by incorporating at least one compound represented by the following formula (I) in at least one silver halide photographic emulsion layer of a silver halide photographic material:

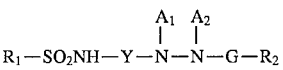

$$R_1-SO_2NH-Y-\overset{A_1}{\overset{|}{N}}-\overset{A_2}{\overset{|}{N}}-G-R_2 \qquad (I)$$

wherein $A_1$ and $A_2$ represent a hydrogen atom at the same time, or one of them represents a hydrogen atom and the other represents a sulfinic acid residue or an acyl group, $R_1$ represents an aliphatic group, an aromatic group, or a heterocyclic group, $R_2$ represents a hydrogen atom, an alkyl group, an aryl group, an alkoxy group, an aryloxy group, or an amino group, these groups for $R_1$ and $R_2$ may be substituted, G represents a carbonyl group, a sulfonyl group, a sulfoxy group, a phosphoryl group, or an N-substituted or unsubstituted iminomethylene group, and Y represents a phenylene group or a naphthylene group, which may be substituted, the sum of the total carbon atoms of the groups for $R_1$, $R_2$, and Y is, however, not less than 13.

DETAILED DESCRIPTION OF THE INVENTION

The compounds shown by formula (I) described above are explained in detail below.

In formula (I), $A_1$ and $A_2$ both represent a hydrogen atom, or one of them represents a hydrogen atom and the other represents an alkylsulfonyl group having not more than 20 carbon atoms, an arylsulfonyl group having not more than 20 carbon atoms (preferably a phenylsulfonyl group phenylsulfonyl group substituted so that the sum of Hammett's substituent constants becomes at least −0.5), or an acyl group having not more than 20 carbon atoms (preferably a benzoyl group, a benzoyl group substituted so that the sum of Hammett's substituent constants becomes at least −0.5, or a straight chain, branched, or cyclic unsubstituted or substituted aliphatic acyl group), examples of the substituent being a halogen atom, an ether group, a sulfonamido group, a carbonamido group, a hydroxy group, a carboxy group, and a sulfon group.

$A_1$ and $A_2$ are most preferably a hydrogen atom.

The aliphatic group shown by $R_1$ in formula (I) preferably has 1 to 60 carbon atoms, and examples include a straight chain, branched or cyclic alkyl group, alkenyl group or alkinyl group.

The aromatic group shown by $R_1$ in formula (I) preferably has 6 to 60 carbon atoms, and examples include a monocyclic or bicyclic aryl group such as a phenyl group and a naphthyl group.

The heterocyclic group shown by $R_1$ in formula (I) is a 3-membered to 10-membered saturated or unsaturated heterocyclic group containing at least one of N, O, and S, which may be a monocyclic ring or may form a condensed ring with other aromatic ring or heterocyclic ring. The heterocyclic ring group shown by $R_1$ is preferably a 5-membered or 6-membered aromatic heterocyclic group such as a pyridine group, an imidazolyl group, a quinolinyl group, an benzimidazolyl group, a pyrimidyl group, a pyrazolyl group, an isoquinolinyl group, a thiazolyl group, or a benzothiazolyl group.

The groups shown by $R_1$ may be substituted by a substituent such as, for example, an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, and a carboxy group. These groups may be further substituted.

These groups shown above may, if possible, combine with each other to form a ring.

$R_1$ is preferably an aromatic group, and more preferably an aryl group.

When G in formula (I) is a carbonyl group, $R_2$ is preferably a hydrogen atom, an alkyl group (e.g., a methyl group, a trifluoromethyl group, a 3-hydroxypropyl group, and a 3-methanesulfonamidopropyl group), an aralkyl group (e.g., an o-hydroxybenzyl group), or an aryl group (e.g., a phenyl group, a 3,5-dichlorophenyl group, an o-methanesulfonamidophenyl group, and a 4-methanesulfonylphenyl group) and is particularly preferably a hydrogen atom.

When G in formula (I) is a sulfonyl group, $R_2$ is preferably an alkyl group (e.g., a methyl group), an aralkyl group (e.g., an o-hydroxyphenylmethyl group), an aryl group (e.g., a phenyl group), or a substituted amino group (e.g., a dimethylamino group).

When G is a sulfoxy group, $R_2$ is preferably a cyanobenzyl group or a methylthiobenzyl group.

When G is an N-substituted or unsubstituted iminomethylene group, $R_2$ is preferably a methyl group, an ethyl group, or a substituted or unsubstituted phenyl group.

When G is a phosphoryl group, $R_2$ is preferably a methoxy group, an ethoxy group, a butoxy group, a phenoxy group or a phenyl group, and particularly preferably a phenoxy group.

The substituents for the groups shown by $R_2$ are an acyl group, an acyloxy group, an alkyloxycarbonyl group, an aryloxycarbonyl group, an alkenyl group, an alkinyl group, and a nitro group in addition to the substituents illustrated above for the groups shown by $R_1$. These substituents may be further substituted and these groups shown above may, if possible, combine with each other to form a ring.

It is preferred that $R_1$ or $R_2$, in particular $R_1$, contains a so-called ballast group, i.e., a nondiffusible group for couplers. The ballast group has at least 8 carbon atoms and composed of alkyl group, a phenyl group, an ether group, an amido group, a ureido group, a urethane group, a sulfonamido group, a thioether group, or a combination thereof.

The sum of the total carbon atoms of $R_1$, $R_2$, and Y (including carbon atoms of the substituents, if any) is at least 13, and preferably at least 21.

If the sum of the aforesaid total carbon atoms is 12 or less, black pepper is liable to occur.

The phenylene group or naphthylene group shown by Y in formula (I) may be substituted by the substituent illustrated above with respect to $R_1$ and $R_2$.

Also, —$SO_2NH$— in formula (I) may be disposed at any position of o-position, m-position and p-position to the hydrazine but preferably at the p-position.

Also, G in formula (I) is most preferably a carbonyl group.

Preferred examples of the compound shown by formula (I) are illustrated below but the invention is not limited to these compounds.

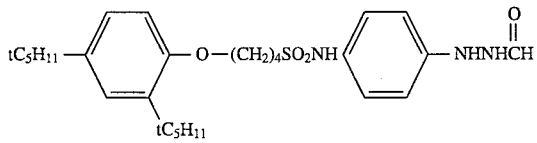

1

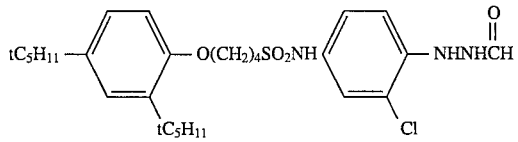

2

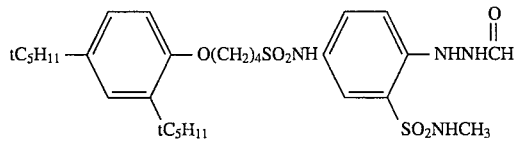

3

-continued
4
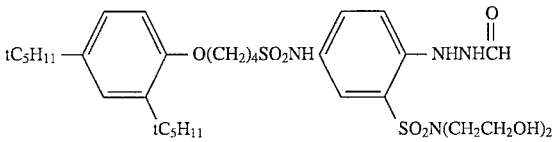
5
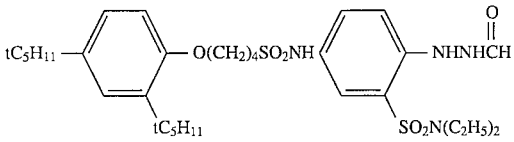
6
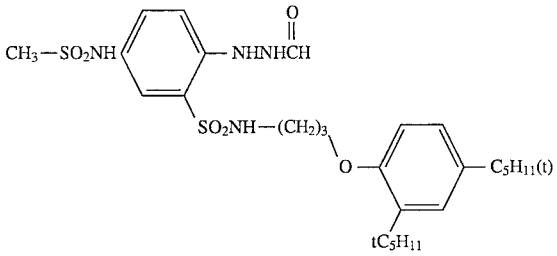
7
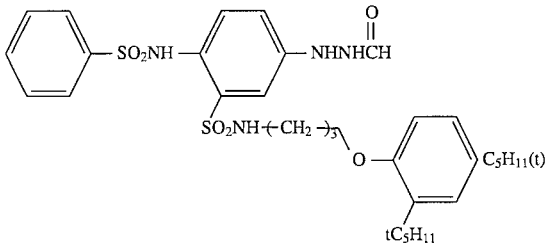
8
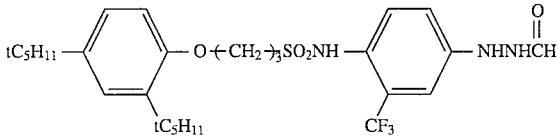
9
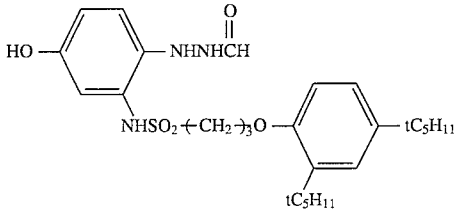
10
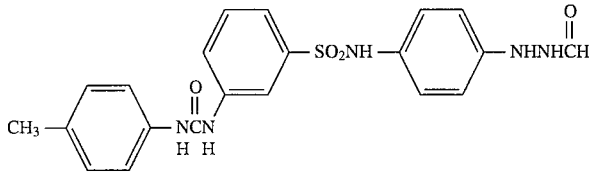
11
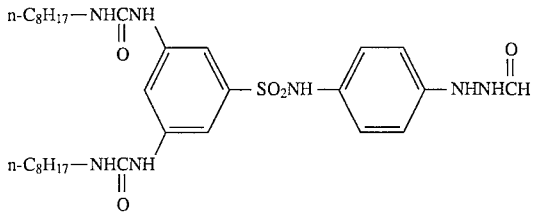

-continued
12
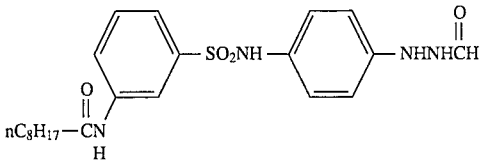
13
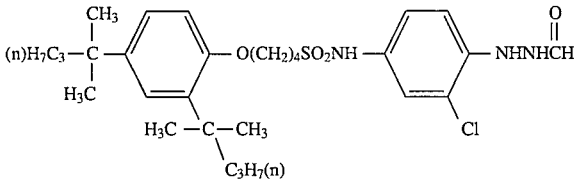
14
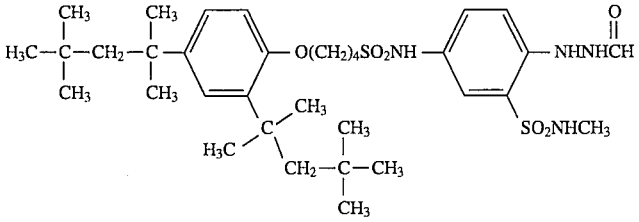
15
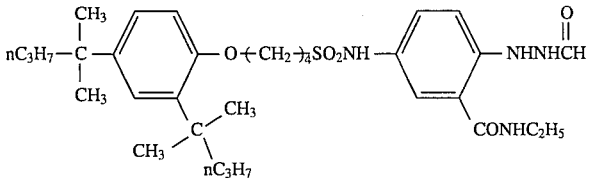
16
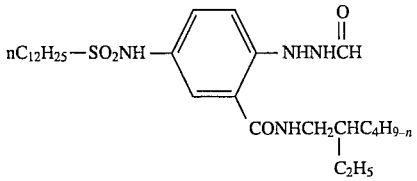
17
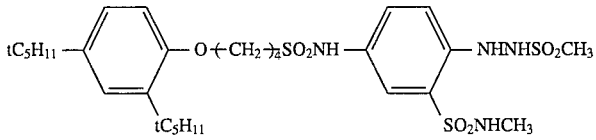
18
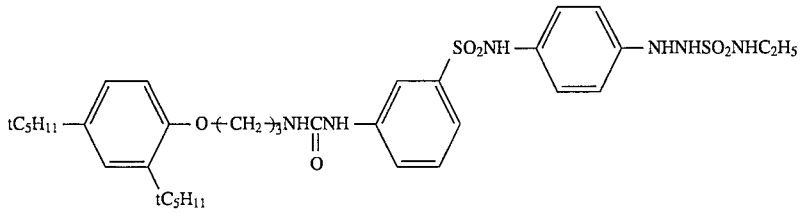
19
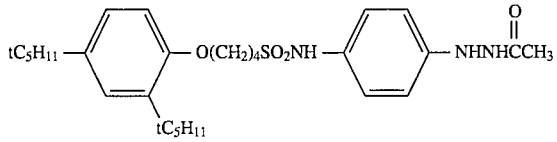
20
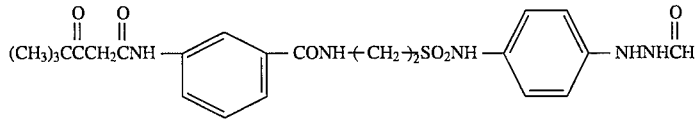

-continued
21
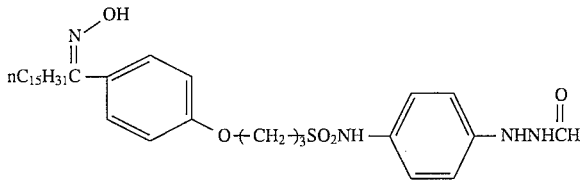
22
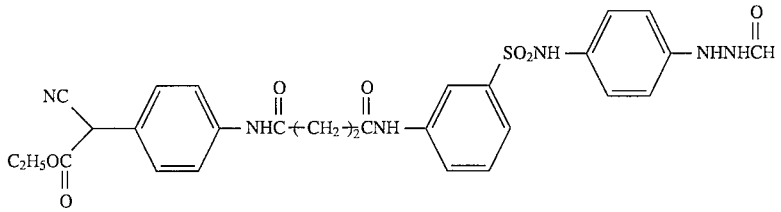
23
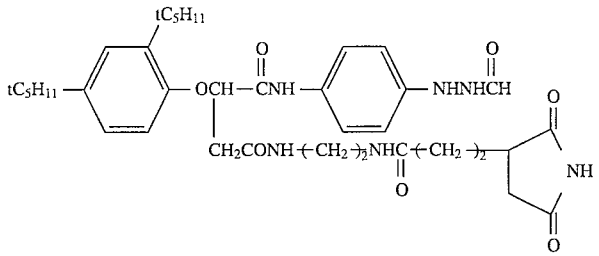
24
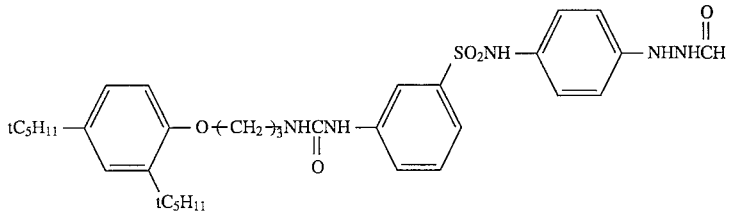
25
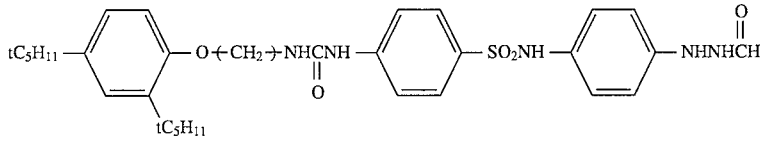
26
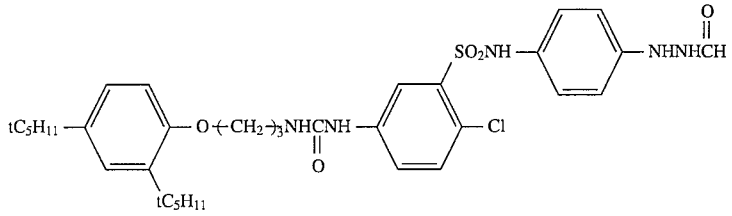
27
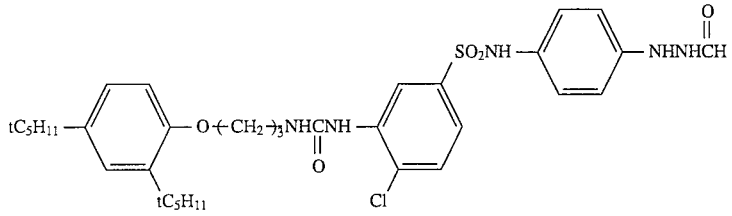

-continued
28
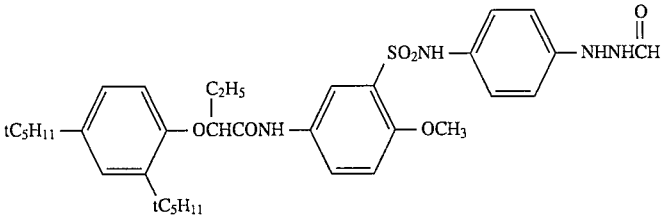
29
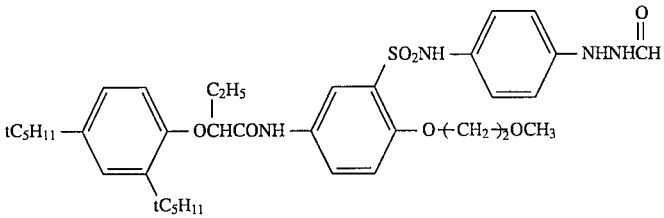
30
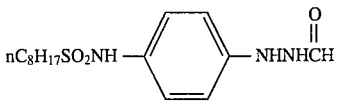
31
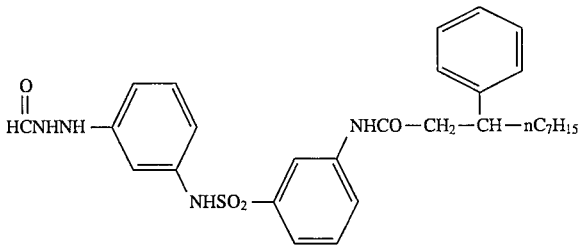
32
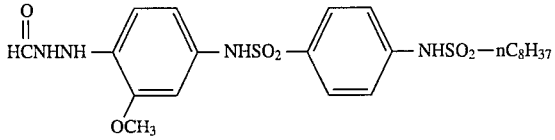
33
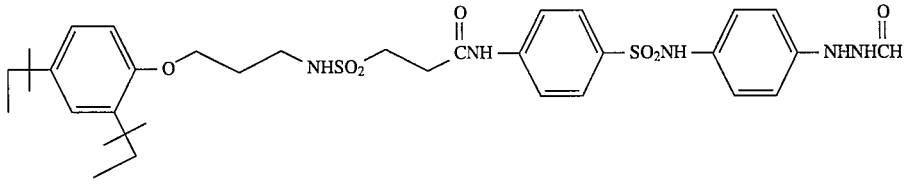
34
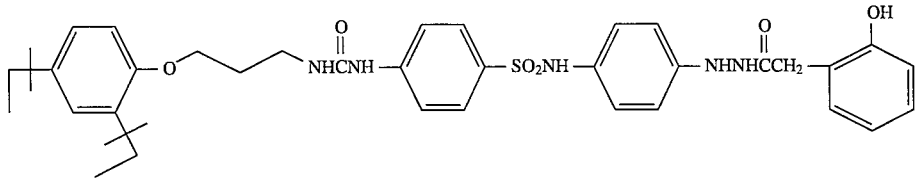
35
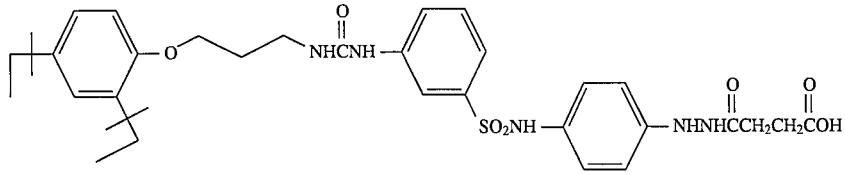

-continued
36
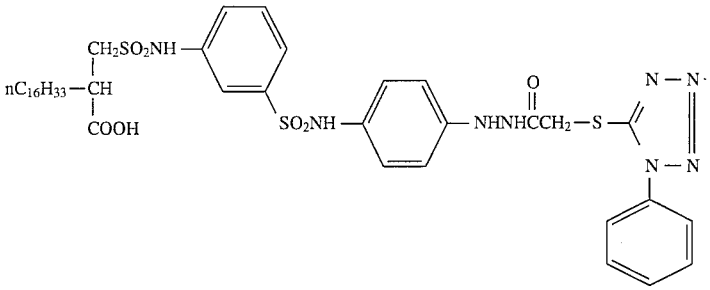
37
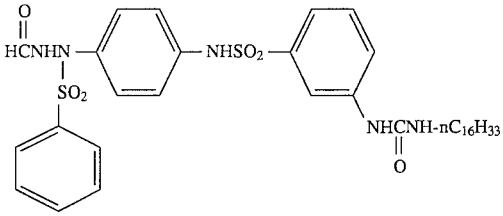
38
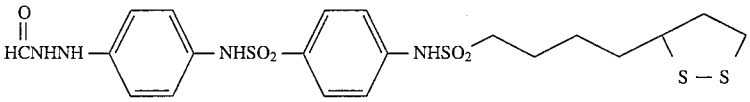
39
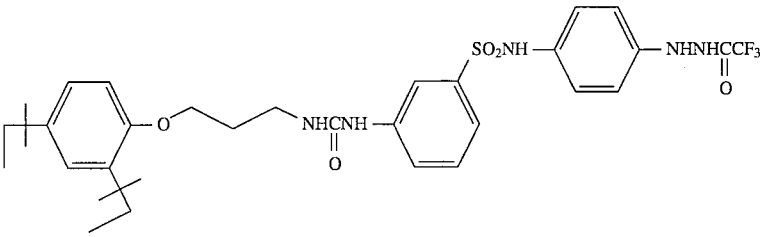
40
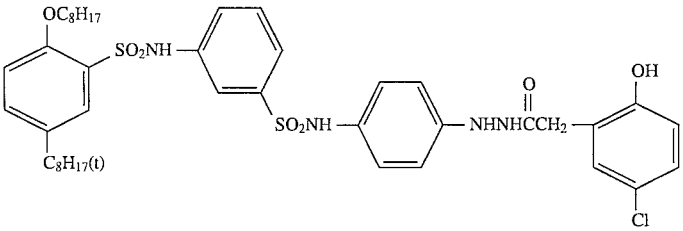
41
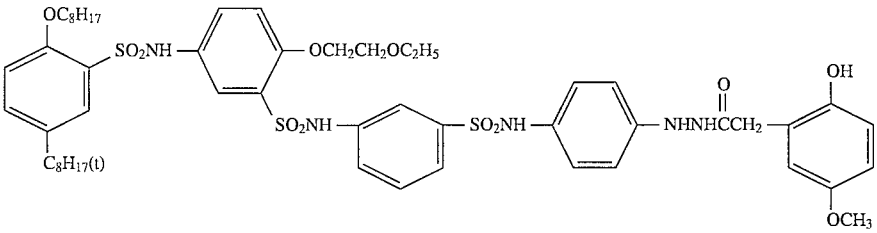
42
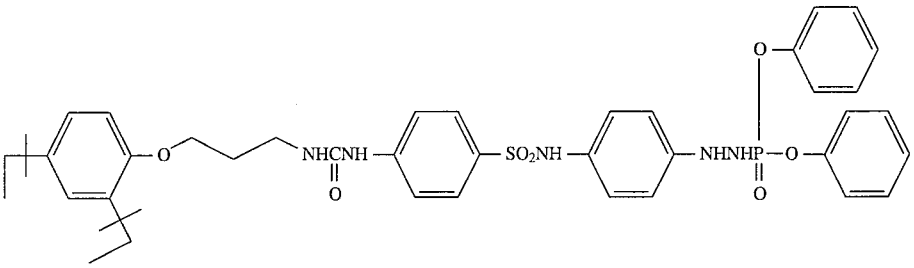

-continued

43

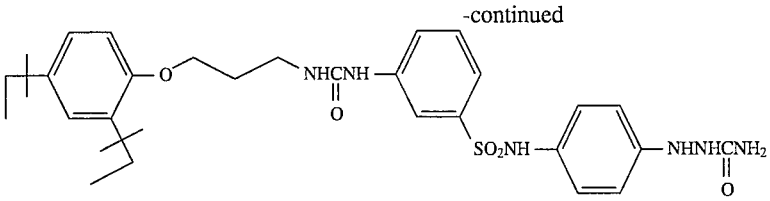

44

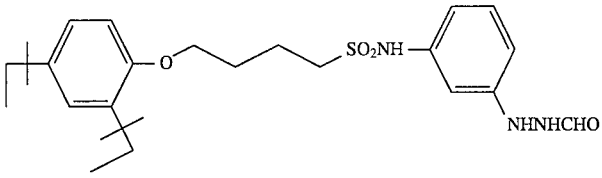

Synthesis examples of typical compounds shown by formula (I) described above are shown below.

SYNTHESIS EXAMPLE 1

Synthesis of Compound 1

In 10 ml of N,N-dimethylformamide was dissolved 2.5 g of 2-(4-aminophenyl)-1-formylhydrazine under a nitrogen gas atmosphere, and after adding 2.1 ml of triethylamine thereto the mixture was cooled to −5° C. Then, a solution obtained by dissolving 5.8 g of 4-(2,4-di-tert-pentylphenoxy)-1-butylsulfonyl chloride in 10 ml of acetonitrile was added dropwise to the aforesaid mixture while cooling with stirring so that the temperature of the mixture was not over 0° C. Then, after stirring the resulting mixture for one hour at 0° C., the reaction mixture was poured onto ice water and extracted with ethyl acetate. The organic layer (extract) was washed with a saturated aqueous sodium chloride solution, dried by anhydrous sodium sulfate, and filtered. The filtrate thus obtained was concentrated and the concentrate was separated and purified by silica gel column chromatography (developing solvent: a mixture of ethyl acetate and chloroform of 2:1 by volume ratio) to provide 2.7 g of the oily desired product.

SYNTHESIS EXAMPLE 2

Synthesis of Compound 24

2-(1): Synthesis of 2-[4-(3-Nitrobenzenesulfonamido)phenyl]-1-formylhydrazine:

In a mixture of 1 liter of N,N-dimethylacetamide, 880 ml of acetonitrile, and 285 g of triethylamine was dissolved 426 g of 2-(4-aminophenyl)-1-formylhydrazine in a nitrogen gas atmosphere and after cooling the solution to −5° C., 625 g of metanitrobenzenesulfonyl chloride was gradually added thereto while cooling the mixture with stirring so that the temperature thereof was not over −5° C. After further stirring the mixture for 1.5 hours at temperature below −5° C., the reaction mixture was extracted with 12 liters of ethyl acetate and 12 liters of a saturated aqueous sodium chloride solution at room temperature. The organic layer was collected, concentrated to 6 liters, and 3 liters of n-hexane was added thereto. The mixture was stirred for 30 minutes at room temperature and crystals thus formed were collected by filtration and then washed with 500 ml of ethyl acetate to provide 680 g of the desired product having melting point of 191° to 193° C.

2-(2): Synthesis of 2-[4-(3-aminobenzenesulfonamido)phenyl]-1-formylhydrazine:

A mixture of 680 g of iron powder, 68 g of ammonium chloride, 6.5 liters of isopropanol, and 2.2 liters of water was heated on a steam bath with stirring and after adding thereto 680 g of the nitro compound obtained in step 2-(1) described above, the resultant mixture Was further refluxed for 1.5 hours. Insoluble matters were filtered away and the filtrate thus obtained was concentrated under reduced pressure. Then, water was added to the residue and crystals thus formed were collected by filtration and washed with 1 liter of isopropanol to provide 535 g of the desired product having melting point of 155° to 156° C.

2-(3): Synthesis of 2-[4-(3-phenoxyamidobenzenesulfonamido)phenyl]-1-formylhydrazine:

In 2.8 liters of N,N-dimethylacetamide was dissolved 450 g of the amino compound obtained in step 2-(2) described above in a nitrogen gas atmosphere, the solution was cooled below −5° C., and after adding 120 ml of pyridine thereto, 230 g of phenyl chloroformate was added dropwise to the mixture while cooling the mixture with stirring so that the temperature thereof was not over −5° C. After further stirring the mixture for one hour at temperature below −5° C., 20 liters of a saturated aqueous sodium chloride solution was added dropwise to the reaction mixture followed by stirring for 30 minutes. Crystals thus formed were collected by filtration and then washed with 2 liters of water to provide 611 g of the desired product having melting point of 195° to 197° C.

2-(4): Synthesis of Compound 24:

In 30 ml of acetonitrile were dissolved 32 g of 3-(2,4-di-tert-pentylphenoxy)-1-propylamine and 15 g of the imidazole, and the solution was heated to 50° C. Then, a solution of 42.6 g of the urethane compound obtained in step 2-(3) described above dissolved in 40 ml of N,N-dimethylacetamide was added dropwise to the solution and the mixture was heated to 50° C. for 1.5 hours with stirring. After cooling the reaction mixture to 30° C., the reaction mixture was poured into a mixture of 1 liter of 0.5M hydrochloric acid and 1 liter of ethyl acetate. The organic layer thus formed was separated, concentrated and recrystallized from a mixture of ethyl acetate and n-hexane of 2:5 by volume ratio to provide 33.6 g of the desired product having melting point (softening point) of 118° to 121° C.

SYNTHESIS EXAMPLE 3

Synthesis of Compound 19

In 10 ml of N, N-dimethylformamide was dissolved 2.5 g of 2-(4-aminophenyl)-1-acetylhydrazine in a nitrogen gas atmosphere and after adding 2.1 ml of triethylamine thereto, the resultant mixture was cooled to −5° C. Then, 10 ml of acetonitrile containing 5.8 g of 4-(2,4-di-tert-pentylphenoxy)-1-butylsulfonyl chloride was added dropwise in the resulting mixture while cooling with stirring so that the temperature thereof was not over 0° C. Then, after further stirring the mixture for 1 hour at 0° C., the reaction mixture was poured into ice water and extracted with ethyl acetate. The organic layer was washed with a saturated aqueous sodium chloride solution and after drying with anhydrous sodium sulfate, the reaction mixture was filtered. The filtrate thus obtained was concentrated and the residue was separated and purified by silica gel column chromatography (developing solvent: a mixture of ethyl acetate and chloroform of 2:1 by volume ratio to provide 3.2 g of the desired product as oily product.

SYNTHESIS EXAMPLE 4

Synthesis of Compound 44

In 30 ml of N,N-dimethylformamide was dissolved 10.6 g of 2-(3-aminophenyl)-1-formylhydrazine under a nitrogen gas atmosphere, and after adding 8.2 ml of triethylamine thereto the mixture was cooled to −5° C. Then, a solution obtained by dissolving 11.3 g of 4-(2,4-di-tert-pentylphenoxy)-1-butylsulfonyl chloride in 20 ml of acetonitrile was added dropwise to the aforesaid mixture while cooling with stirring so that the temperature of the mixture was not over 0° C. Then, after stirring the resulting mixture for one hour at 0° C., the reaction mixture was poured onto ice water and extracted with ethyl acetate. The organic layer (extract) was washed with a saturated aqueous sodium chloride solution, dried by anhydrous sodium sulfate, and filtered. The filtrate thus obtained was concentrated and the concentrate was separated and purified by silica gel column chromatography (developing solvent: a mixture of ethyl acetate and chloroform of 2:1 by volume ratio) to provide 12.2 g of the solid desired product.

SYNTHESIS EXAMPLE 5

Synthesis of Compound 2

5-(1): Synthesis of 1-(2-chloro-4-nitrophenyl)hydrazine:

In 712 ml of acetonitrile was dissovled 59 ml of hydrazine hydrate at room temperature in a nitrogen gas atmosphere and then a solution of 46.3 g of 1,2-dichloro-4-nitrobenzene dissolved in 71 ml of acetonitrile was added dropwise to the solution. Thereafter, the mixture was refluxed for 4 hours and after concentrating the reaction mixture, 500 ml of water was added to the residue. Crystals thus formed were collected by filtration and after adding thereto 200 ml of acetonitrile, the mixture was refluxed for 30 minutes. The reaction mixture was ice-cooled to room temperature and crystals thus formed were collected by filtration to provide 27 g of the desired product.

5-(2): Synthesis of 2-(2-chloro-4-nitrophenyl)-1-formylhydrazine:

In 160 ml of acetonitrile was dissolved 27 g of the hydrazine compound obtained in step 5-(1) described above in a nitrogen gas atmosphere and then 14 ml of formic acid was added dropwise to the solution. After refluxing the mixture for 2 hours, the reaction mixture was ice-cooled and crystals thus formed were collected by filtration and washed with acetonitrile to provide 20.3 g of the desired product.

5-(3): Synthesis of 2-(4-amino-2-chlorophenyl)-1-formylhydrazine:

A mixture of 19.5 g of the nitro compound obtained in step 5-(2) described above, 20 g of iron powder, 2 g of ammonium chloride, 400 ml of isopropanol, and 20 ml of water was refluxed on a steam bath for 2 hours with stirring. Then, insoluble matters were filtered away while the mixture was hot, the filtrate thus obtained was concentrated to about 200 ml under reduced pressure and ice-cooled. Crystals thus formed were collected by filtration and washed with 200 ml of isopropanol to provide 11.0 g of the desired product.

5-(4): Synthesis of Compound 2

In 30 ml of N,N-dimethylformamide was dissolved 5.55 g of 2-(4-amino-2-chlorophenyl)-1-formylhydrazine in a nitrogen gas atmosphere and after adding 3.03 g of triethylamine thereto, the mixture was cooled to −5° C. Then, a solution of 11.8 g of 4-(2,4-di-tert-pentylphenoxy)-1-butylsulfonyl chloride dissolved in 10 ml of acetonitrile was added dropwise to the mixture while cooling with stirring so that the temperature thereof was not over 0° C. Then, after further stirring the mixture for one hour at 0° C., the reaction mixture was poured into ice water and extracted with ethyl acetate. The organic layer thus formed was washed with a saturated aqueous sodium chloride solution, dried with anhydrous sodium sulfate, and filtrated. The filtrate thus obtained was concentrated and the residue was separated and purified by silica gel column chromatography (developing solvent: a mixture of ethyl acetate and chloroform of 1:2 by volume ratio to provide 7.0 g of the desired product having melting point of 157° to 159° C.

SYNTHESIS EXAMPLE 6

Synthesis of Compound 5

6-(1): Synthesis of 2-chloro-1-diethylsulfamoyl-5-nitro benzene:

In 50 ml of acetone was dissolved 7.6 g of 2-chloro-5-nitrophenylsulfonyl chloride and after cooling the solution to −10° C., a solution of 3.03 g of triethylamine and 2.2 g of diethylamine dissolved in 20 ml of acetonitrile was added dropwise to the solution while cooling with stirring so that the temperature thereof was not over 0° C. Then, the temperature of the reaction mixture was gradually raised to room temperature and an aqueous hydrochloric acid solution having pH of about 2 was added to the mixture. Crystals thus formed were collected by filtration and washed with water to provide 7.8 g of the desired product.

6-(2): Synthesis of 1-(2-diethylsulfamoyl-4-nitrophenyl)-hydrazine:

In 90 ml of methanol was dissolved 7.0 g of the chloro compound obtained in step 6-(1) described above and after refluxing the solution, a solution of 6.2 ml of hydrazine hydrate dissolved in 30 ml of ethanol was added dropwise to the solution. After further refluxing for 4 hours, the reaction mixture was concentrated to provide 7.8 g of the desired product.

6-(3): Synthesis of 2-(2-diethylsulfamoyl-4-nitrophenyl)-1-formylhydrazine:

In 25 ml of acetonitrile was dissolved 5 g of the hydrazine compound obtained in step 6-(2) described above in a nitrogen gas atmosphere and then 2 ml of formic acid was added dropwise to the solution. After refluxing the mixture for 5 hours, the reaction mixture was concentrated under reduced pressure, 100 ml of water was added thereto and the mixture was stirred for one hour at room temperature. Crystals thus formed were collected by filtration and recrystallized from ethanol to provide 4.0 g of the desired product.

6-(4): Synthesis of 2-(4-amino-2-diethylsulfamoylphenyl)-1-formylhydrazine:

In 210 ml of ethanol and 90 ml of water was dissolved 10 g of the nitro compound obtained in step 6-(3) in a nitrogen gas atmosphere and then a solution of 27 g of hydrosulfite dissolved in 120 ml of water was added dropwise to the solution. After stirring the mixture for 30 minutes at room temperature, the mixture was further stirred for 15 minutes at 60° C. After filtering away insoluble matters, the filtrate was concentrated under reduced pressure, 100 ml of water was added to the residue, and crystals thus formed were collected by filtration and recrystallized from ethanol to provide 3.7 g of the desired product.

6-(5): Synthesis of Compound 5

In 17 ml of acetonitrile was dissolved 1.7 g of the amino compound obtained in Step 6-(4) in a nitrogen gas atmosphere and after refluxing the solution, a solution of 2.8 g of 4-(2,4-di-tert-pentylphenoxy)-1-butylsulfonyl chloride dissolved in 2.8 ml of acetonitrile was added dropwise to the solution. After further refluxing the mixture for 1 hour, 200 ml of water was added to the reaction mixture. After removing the supernatant liquid formed, n-hexane was added to the residue, whereby the residue was solidified. Then, n-hexane as the supernatant liquid was further removed and the residue formed was washed with ether to provide 1.4 g of the desired product having melting point of 169° to 171° C.

In the case of incorporating the compound of formula (I) for use in this invention in a silver halide emulsion layer, after dissolving the compound in water or a water-miscible organic solvent (if necessary, an alkali hydroxide or a tertiary amine may be added to the compound to form a salt thereof before dissolving the compound), the solution may be added to the silver halide emulsion (in this case, if necessary, the pH may be adjusted by the addition of an acid or alkali). The compounds shown by formula (I) may be used singly or as a mixture thereof. The amount can be properly selected according to the properties of the silver halide emulsion used.

When the compound of formula (I) for use in this invention is used as a combination with a negative working silver halide emulsion, negative images having high contrast can be formed. On the other hand, the compound of formula (I) can be also used as a combination with an internal latent image type silver halide emulsion. However, the compound of formula (I) is preferably used for forming negative images having high contrast as a combination of a negative working silver halide emulsion.

When the compound of formula (I) is utilized for forming negative images of high contrast, the addition amount of the compound is from $1\times10^{-5}$ to $5\times10^{-2}$ mol, and preferably from $2\times10^{-5}$ to $1\times10^{-2}$ mol per mol of silver halide in the emulsion. In the case, the mean grain size of the silver halide grains of the silver halide emulsion is preferably fine (e.g., less than 0.7 μm), and particularly preferably not larger than 0.5 82 m. These is fundamentally no restriction on the grain size distribution of the silver halide emulsion for use in this invention but a monodisperse silver halide emulsion is preferred. The monodisperse silver halide emulsion is the emulsion containing silver halide grains at least 95% by weight or by number of which are within ±40% of the mean grain size.

The silver halide grains in the photographic emulsion for use in this invention may have a regular crystal form such as cubic, octahedral, etc., an irregular crystal form such as spherical, tabular, etc., or a composite form of these crystal forms.

The silver halide grains may have uniform phase or different phases between the inside and the surface layer thereof. Furthermore, the silver halide emulsion may be composed of a mixture of two or more silver halide emulsions separately formed.

In the stage of forming or physical ripening silver halide grains for producing the silver halide emulsion for use in this invention, a cadmium salt, a sulfite, a lead salt, a thallium salt, a rhodium salt or a complex salt thereof, an iridium salt or a complex salt thereof, etc., may exist in the system.

The silver halide particularly suitable for the invention is a silver haloiodide prepared in the presence of an iridium salt or a complex salt thereof, or a rhodium salt or a complex salt thereof in an amount of from $10^{-8}$ to $10^{-5}$ mol per mol of silver, wherein the silver iodide content at the surface of the silver halide grains is higher than the mean silver iodide content of the grains. By using the emulsion containing such a silver haloiodide, photographic characteristics having a higher sensitivity and high gamma is obtained.

The silver halide emulsion for use in this invention may not be chemically sensitized but may be chemically sensitized. For chemically sensitizing the silver halide emulsions, there are a sulfur sensitization method, a reduction sensitization method, and a noble metal sensitization method and they may be used individually or as a combination thereof.

In the noble metal sensitization method, a gold sensitization method is typical and as a gold compound, a gold complex salt is mainly used. Complex salts of other noble metals than gold, such as platinum., palladium, rhodium, etc., can be also used. Practical examples thereof are described in U.S. Pat. No. 2,448,060 and British Patent 618,061.

As a sulfur sensitizer for the sulfur sensitization method, sulfur compounds contained in gelatin as well as various sulfur compounds such as thiosulfates, thioureas, thiazoles, rhodanines, etc., can be used.

In the aforesaid method, it is preferred that an iridium salt is added to the system in the amount described above before finishing the physical ripening, in particular at the formation of silver halide grains in the production of the silver halide emulsion.

The iridium salt for use in this invention is a water-soluble iridium salt or an iridium complex salt, and examples thereof include iridium trichloride, iridium tetrachloride, potassium hexachloroiridate (III), potassium hexachloroiridate (IV), and ammonium hexachloroiridate (III).

Examples of the rhodium salt and a complex salt thereof which can be used include rhodium monochloride, rhodium dichloride, rhodium trichloride, ammonium hexachlororhodate, and water-soluble halogeno complex salts of trivalent rhodium, for example, hexachlororhodium (III) acid or its salts (e.g., ammonium salt, sodium salt, potassium salt, etc.), with the complex salts being preferred.

It is preferred in the point of increasing the maximum density (Dmax) that the silver halide emulsion layer in this invention contains two or more kinds of monodisperse emulsions having different mean grain sizes as shown in Japanese Patent Application (OPI) Nos. 223734/86 and 90646/87. Also, the small monodisperse silver halide grains in the monodisperse emulsions are preferably chemically sensitized and for the chemical sensitization, a sulfur sensitization is most preferred. In the case of a monodisperse emulsion containing large silver halide grains, the emulsion may not be chemically sensitized but may be, if desired, chemically sensitized. The silver halide emulsion containing large silver halide grains is generally not chemically sensitized since in such case, black pepper is liable to occur, and hence in the case of applying a chemical sensitization, it is particularly preferred to apply the chemical sensitization to a shallow extent of not causing black pepper. The term "applying to a shallow extent" in this invention means that the chemical sensitization is applied for a time of shorter than the time of applying chemical sensitization to small silver halide grains or that the chemical sensitization is applied at a low temperature or in a restrained amount of the chemical sensitizer.

There is no particular restriction on the sensitivity difference between the monodisperse emulsion containing large silver halide grains and the monodisperse emulsion containing small silver halide grains but it is preferred that the sensitivity of the former is higher than that of the latter by the range of from 0.1 to 1.0, and more preferably from 0.2 to 0.7 as ΔlogE. Herein, the "sensitivity" of each emulsion is measured by adding thereto a hydrazine derivative to the emulsion, coating the emulsion on a support, and processing the emulsion using a developer containing more than 0.15 mol/liter of a sulfite ion and having pH of from 10.5 to 12.3.

The mean silver halide grain size of the silver halide grains of the small size silver halide monodisperse emulsion is less than 90%, and preferably less than 80% of the mean grain size of the silver halide grains in the large size silver halide monodisperse emulsion. The mean grain size of the silver halide grains in the silver halide emulsions for use in this invention is preferably from 0.02 to 1.0 μm, and more preferably from 0.1 to 0.5 μm, and it is preferred that the mean grain sizes of the silver halide grains in the large size silver halide monodisperse emulsion and the small size silver halide monodisperse emulsion for use in this invention are in the aforesaid range.

In the case of using two or more kinds of silver halide emulsions containing silver halide grains, each having a different grain size in this invention, the coating amount of silver for the small size silver halide monodisperse emulsion is preferably from 40 to 90% by weight, and more preferably from 50 to 80% by weight of the total coating amount of silver.

In this invention, the monodisperse silver halide emulsions containing silver halide grains, each having a different mean grain size, may be introduced into a same emulsion layer or separate emulsion layers. In the case of introducing the monodisperse emulsions into separate emulsion layers, it is preferred that the large size silver halide monodisperse emulsion is introduced into the upper layer (surface side) and the small size silver halide emulsion into the lower layer (support side).

In addition, the total coating amount of silver is preferably from 1 to 8 g/m$^2$.

The photographic light-sensitive material of this invention may contain sensitizing dye(s) (e.g., a cyanine dye and a merocyanine dye) described in Japanese Patent Application (OPI) No. 52050/80, pages 45–53.

These sensitizing dyes may be used singly or as a combination thereof and a combination of sensitizing dyes is frequently used for super color sensitization.

The photographic light-sensitive material of this invention may further contain in the emulsion layer(s) a dye which does not have a spectral sensitization action by itself or a material which does not substantially absorb visible light and shows super color sensitizing action.

Useful sensitizing dyes, the combination of dyes showing super color sensitization, and materials showing super color sensitizing action are described in *Research Disclosure,* Vol. 176, No. 17643, page 23, IV-J (December, 1978).

The photographic light-sensitive materials of this invention can contain various kinds of compounds for preventing the formation of fog during the production, storage and processing of the light-sensitive materials, or for stabilizing the photographic performance thereof. That is, there are many compounds known as antifoggants or stabilizers, for example, azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolinethione, etc.; azaindenes such as triazaindenes, tetraazaindenes (in particular, 4-hydroxysubstituted (1,3,3a,7)tetraazaindenes), pentaazaindenes, etc.; benzenethiosulfonic acid; benzenesulfinic acid, and benzenesulfonic acid amide. Of the aforesaid compounds, benzotriazoles (e.g., 5-methylbenzotriazole) and nitroindazoles (e.g., 5-nitroindazole) are preferred. These compounds may, as the case may be, incorporated in processing solutions.

The photographic light-sensitive materials of this invention may further contain inorganic or organic hardening agents in the photographic emulsion layers or other hydrophilic colloid layers. Examples of these hardening agents are chromium salts, aldehydes (e.g., formaldehyde and glutar aidehyde), N-methylol compounds (e.g., dimethylolurea), active vinyl compounds (e.g., 1,3,5-triacryloyl-hexahydrostriazine and 1,3-vinylsulfonyl-2-propanol), active halogen compounds (e.g., 2,4-dichloro-6-hydroxy-s-triazine), and mucochloric acids. They can be used singly or a combination thereof.

The photographic light-sensitive materials of this invention may further contain various surface active agents for various purposes such as coating aid, static prevention, slidability improvement, dispersibility improvement, sticking prevention, and improvements of photographic properties (e.g., development acceleration, contrast increase, and sensitivity increase).

Surface active agents which are preferably used in this invention are polyalkylene oxides having a molecular weight of at least 600 described in Japanese Patent Publication No. 9412/83. When the surface active agents are used as antistatic agent, the surface active agents containing fluorine (as described in U.S. Pat. No. 4,201,586, Japanese Patent Application (OPI) Nos. 80849/85 and 74554/84) are particularly preferred.

The photographic light-sensitive materials of this invention can further contain matting agents such as silica, magnesium oxide, polymethyl methacrylate particles, etc., in the photographic emulsion layers or other hydrophilic colloid layers thereof.

The silver halide photographic emulsions for use in this invention can contain a dispersion of a water-insoluble or water sparingly soluble synthetic polymer for improving the dimensional stability. Examples of such a polymer are polymers composed of an alkyl (meth)-acrylate, an alkoxyacryl (meth)acrylate, a glycidyl (meth)-acrylate, etc., singly or a combination of these acrylates, or as a combination thereof and other monomer such as acrylic acid, methacrylic acid, etc.

The photographic light-sensitive materials of this invention preferably contain a compound having an acid group in the silver halide emulsion layers or other layers. As the compound having an organic acid, there are organic acids such as salicylic acid, acetic acid, ascorbic acid, etc., and polymers or copolymers having an acid monomer such as acrylic acid, maleic acid, phthalic acid, etc., as a recurring unit. These compounds are described in Japanese Patent Application (OPI) Nos. 223834/86, 228437/86, 25745/87 and 55642/87. In these compounds, ascorbic acid is particularly preferred as the low molecular compound and an aqueous latex of a copolymer composed of an acid monomer such as acrylic acid and a crosslinking monomer having 2 or more unsaturated groups, such as divinylbenzene is particularly preferred as the high molecular compound.

For obtaining high-sensitive and high contrast photographic characteristics by using the silver halide photographic materials of this invention, it is unnecessary to use a conventional infectious developer or a developer having a high alkalinity of pH near 13 described in U.S. Pat. No. 2,419,975 and a stable developer can be used.

That is, the silver halide photographic material of this invention can provide negative images of sufficiently high contrast using a developer containing sulfite ions in an amount of at least 0.15 mol/liter as preservative and having pH of from 10.5 to 12.3, and particularly from 11.0 to 12.0.

There is no particular restriction on the developing agent for the developer which is used for developing the photographic materials of this invention, but from the point of easily obtaining good dot image quality the developing agent preferably includes dihydroxybenzenes. The developer sometimes contains a combination of a dihydroxybenzene and a 1-phenyl-3-pyrazolidone or a combination of a dihydroxybenzene and a p-aminophenol.

The developing agent is preferably used in an amount of from 0.05 to 0.8 mol/liter. When a combination of a dihydroxybenzene and a 1-phenyl-3-pyrazolidone or a p-aminophenol is used, it is preferred that the former is used in an amount of from 0.05 to 0.5 mol/liter and the latter in an amount of less than 0.06 mol/liter.

As the sulfite which is used as a preservative in this invention, there are sodium sulfite, potassium sulfite, lithium sulfite, ammonium sulfite, sodium hydrogensulfite, potassium metahydrogensulfite, formaldehyde-sodium hydrogensulfite. The sulfite is used in an amount of at least 0.4 mol/liter, and particularly at least 0.5 mol/liter.

The developer in this invention can contain a compound described in Japanese Patent Application (OPI) No. 24347/81 as a silver stain preventing agent.

The developer can further contain a compound described in Japanese Patent Application (OPI) No. 267759/86 as a dissolution aid. Furthermore, the developer can contain a compound described in Japanese Patent Application (OPI) No. 93433/85 or a compound described in Japanese Patent Application (OPI) No. 186259/87 as a pH buffer.

The compound shown by formula (I) described above is used for high contrast photographic light-sensitive materials as a combination with a negative working silver halide emulsion as described above but can be also used as a combination with an internal latent image type silver halide emulsion and this embodiment is explained below.

It is preferred that the content of the compound shown by formula (I) in the internal latent image type emulsion layer is an amount giving sufficient maximum density (e.g., at least 1.0 as silver density) in the case of developing the emulsion with a surface developer. In fact, the amount of the compound differs according to the characteristics of the silver halide emulsion used, the chemical structure of the nucleating agent and the developing condition, and the proper amount thereof can be changed in a wide range but is usually in the range of from about 0.005 to 500 mg, and preferably from about 0.01 to 100 mg per mol of silver in the internal latent image type silver halide emulsion.

The definition of the internal latent image type silver halide emulsion is described in Japanese Patent Application No. 170733/86, page 10 and British Patent 2,089,057, pages 18 to 20.

The internal latent image type silver halide emulsions for the photographic light-sensitive materials of this invention may be spectrally sensitized to blue light of relative long wavelengths, green light, red light or infrared light using sensitizing dyes. As the sensitizing dyes, there are cyanine dyes, merocyanine dyes, complex cyanine dyes, complex merocyanine dyes, holopolar cyanine dyes, styryl dyes, hemicyanine dyes, oxonol dyes, hemioxonol dyes, etc. These sensitizing dyes also include cyanine dyes and merocyanine dyes described in Japanese Patent Application (OPI) Nos. 40638/84, 40636/84 and 38739/84.

The photographic light-sensitive materials of this invention can contain color image-forming couplers as coloring materials or can be developed by developers containing color image-forming couplers.

Practical examples of these cyan couplers, magenta couplers, and yellow couplers which can be used in this invention are described in the patent cited in *Research Disclosure,* No. 17643 (December, 1978), VII-D and ibid., No. 18717 (November, 1979).

In this invention, couplers giving colored dyes having a proper diffusibility, non-coloring couplers, DIR couplers releasing a development inhibitor upon coupling reaction, or couplers releasing a development accelerator upon coupling reaction can be also used.

Typical examples of the yellow couplers which can be used in this invention are oil-protect type acylacetamido series couplers.

In this invention, the use of 2-equivalent yellow couplers is preferred and typical examples thereof are oxygen atom-releasing type yellow couplers and nitrogen atom-releasing type yellow couplers. In these couplers, α-pivaloylacetanilide series yellow couplers are excellent in fastness, in particular, light fastness of colored dyes formed therefrom and α-benzylacetanilide series yellow couplers give high color density.

As the magenta couplers which can be used in this invention, there are oil-protect type indazolone series and cyanoacetyl series couplers, and preferably pyrazoloazole series couplers such as 5-pyrazolone couplers and pyrazolotriazole couplers. The 5-pyrazolone couplers having an arylamino group or an acylamino group at the 3-position are preferred in the view points of the hue of the colored dyes and the color density thereof.

As the releasing group for the 2-equivalent 5-pyrazolone series magenta couplers, the nitrogen atom-releasing groups described in U.S. Pat. No. 4,310,619 and the arylthio groups described in U.S. Pat. No. 4,351,897 are particularly preferred. Also, 5-pyrazolone series couplers having a ballast group described in European Patent 73,636 give high coloring density.

Examples of the pyrazoloazole series magenta couplers are pyrazolobenzimidazoles described in U.S. Pat. No. 3,379,899, preferably pyrazolo[5,1-c][1,2,4]triazoles described in U.S. Pat. No. 3,725,067, pyrazolotetrazoles described in *Research Disclosure,* No. 24220 (June, 1984), and pyrazoloazoles described in *Research Disclosure,* No. 24230 (June, 1984). Also, in the points of showing less yellow side absorption of colored dyes and of the light-fastness thereof, imidazo[1,2-b]pyrazoles described in European Patent 119,741 are preferred and pyrazolo[1,5-b][1,2,4]triazoles described in European Patent 119,860 are particularly preferred.

As the cyan couplers which can be used in this invention, there are oil-protect type naphtholic and phenolic couplers. Examples thereof are naphtholic couplers described in U.S. Pat. No. 2,474,293, and preferably oxygen atom-releasing type 2-equivalent naphtholic couplers described in U.S. Pat.

Nos. 4,052,212, 4,146,396, 4,228,233, and 4,296,200. Also, typical examples of the phenolic cyan couplers are described in U.S. Pat. Nos. 2,369,929, 2,801,171, 2,772,162, 2,895,826, etc. Cyan couplers having high fastness to humidity and temperature are preferably used in this invention and typical examples thereof are phenolic cyan couplers having an alkyl group having 2 or more carbon atoms at the meta-position of the phenol nucleus described in U.S. Pat. No. 3,772,002, 2,5-diacylamino-substituted phenolic couplers, and phenolic couplers having a phenylureido group at the 2-position and an acylamino group at the 5-position thereof.

It is preferred for correcting unnecessary absorption at short wavelength region of the dyes formed from magenta and cyan couplers to use colored couplers together with these couplers for the color photographic materials for photographing.

In this invention, the graininess can be improved by using couplers giving colored dyes having a proper diffusibility together with the aforesaid color image-forming couplers. As these couplers giving diffusible dyes, typical examples of the magenta couplers are described in U.S. Pat. No. 4,366,237 and British Patent 2,125,570 and typical examples of the yellow, magenta, and cyan couplers are described in European Patent 96,570 and West German Patent Application (OLS) No. 3,234,533.

The aforesaid dye image-forming couplers and the aforesaid specific couplers may form dimers or more polymers. Typical examples of the polymerized dye forming-couplers are described in U.S. Pat. Nos. 3,451,820 and 4,080,211. Specific examples of the polymerized magenta couplers are described in British Patent 2,102,173 and U.S. Pat. No. 4,367,282.

The various kinds of couplers can be used as an admixture thereof in one emulsion layer of the light-sensitive material of this invention for meeting the characteristics required for the light-sensitive material, or further a same kind of coupler can be introduced into two or more different emulsion layers for the similar purpose.

An amount of the coloring coupler is generally within the range of from 0,001 to 1 mol per mol of the light-sensitive silver halide in the silver halide emulsion layer, with from 0.01 to 0.5 mol of a yellow coupler, from 0,003 to 0.3 mol of a magenta coupler, and from 0.002 to 0.3 mol of a cyan coupler, per mol of the light-sensitive silver halide being preferred.

In this invention, the developing agent such as hydroxybenzenes (e.g., hydroquinones), aminophenols, 3-pyrazolidones, etc., may be incorporated in the photographic light-sensitive materials such as the emulsion layers thereof.

The silver halide photographic emulsions for use in this invention can be used for obtaining desired transferred images onto image-receiving layers after proper processing by combining with dye image-providing compounds (coloring materials) for color diffusion transfer process releasing a diffusible dye in conformity with the development of silver halide.

As the coloring materials for such color diffusion transfer process, various materials are known and the coloring materials of the type that the material is originally non-diffusible but releases a diffusible dye by being cleaved by the oxidation-reduction reaction with the oxidation of a developing agent (or an electron transferring agent) (hereinafter, the coloring compound is referred to as DRR compound). In particular, DRR compounds having an N-substituted sulfamoyl group are preferred. DRR compounds which can be particularly preferably used together with the nucleating agent in this invention are DRR compounds having an o-hydroxyarylsulfamoyl group as described in U.S. Pat. Nos. 4,055,428, 4,053,312 and 4,336,322 and DRR compounds having a redox mother nucleus as described in Japanese Patent Application (OPI) No. 149328/78. When the nucleating agent is used together with such a DRR compound, the temperature dependence of the photographic light-sensitive material at processing is remarkably low.

Specific examples of the DRR compounds are compounds described in the aforesaid patents as well as magenta dye image-forming materials such as 1-hydroxy-2-tetramethylenesulfamoyl-4-[3'-methyl-4'-(2"-hydroxy-4"-methyl-5"-hexadecyloxyphenylsulfamoyl)phenylazo]naphthalene, etc., and yellow dye image-forming materials such as 1-phenyl-3-cyano4-(2",4"-di-tert-pentylphenoxyacetamino)phenylsulfamoyl]phenylazo]-5-pyrazolone, etc.

The photographic light-sensitive materials of this invention using internal latent image type silver halide emulsions can provide direct positive images by developing using a surface developer. The surface developer is a developer wherein the development is substantially induced by the latent images or fogged nuclei existing at the surfaces of silver halide grains. It is preferred that the developer does not contain a silver halide dissolving agent but the developer may contain a silver halide dissolving agent (e.g., a sulfite) to some extent if the internal latent images do not substantially take part in the development until the development by the surface development centers of silver halide grains is finished.

For developing the photographic light-sensitive materials of this invention using internal latent image type silver halide emulsions, various kinds of developing agents can be used.

The present invention is explained in more detail by reference to the following examples, but this invention is not limited thereto.

EXAMPLE 1

Emulsions A and B shown below were prepared.

Emulsion A

A cubic grain monodisperse silver halide emulsion having a mean grain size of 0.3 μm and mean silver iodide content of 1 mol % was prepared by simultaneously adding an aqueous solution of silver nitrate and an aqueous solution of potassium iodide and potassium bromide to an aqueous gelatin solution kept at 50° C. in the presence of $4\times10^{-7}$ mol per mol of silver of iridium hexachloride and ammonia while keeping pAg at 7.8.

Emulsion B

A cubic grain monodisperse silver halide emulsion having a mean grai size of 0.22 μm and a mean silver iodide content of 0.1 mol % was prepared by controlling the amounts of potassium iodide and ammonia in the aforesaid method of preparing Emulsion A.

For Emulsions A and B, soluble salts were removed by flocculation method.

Then, by applying a sulfur sensitization to Emulsion B using hypo, a sulfur-sensitized cubic grain monodisperse silver halide emulsion having a mean grain size of 0.22 μm and a mean silver iodide content of 0.1 mol % was prepared.

After adding sodium salt of 5,5'-dichloro-9-ethyl- 3,3'-bis(3-sulfopropyl)oxacarbocyanine as a sensitizing dye, 4-hydroxy-6-methyl-1,3,3a,7-tetraazaindene as a stabilizer, aqueous latex (a) containing 10% by weight of a polymer having the following structure

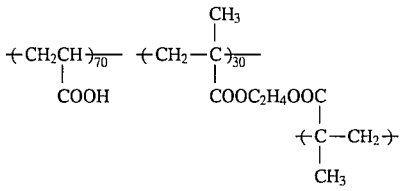

a dispersion of polyethyl acrylate, and 1,3-divinylsulfonyl-2-propanol to each of these emulsions prepared, Emulsion A was mixed with Emulsion B so that the weight ratio of the silver halides (A/B) in the emulsions became ¼, and after adding the compound of formula (I) shown in Table 1 below to the mixture, the mixed emulsion was coated on a polyethylene terephthalate film so that the coated amount of silver became 3.4 g/m$^2$. Each of the samples thus prepared was light-exposed and developed, and the photographic characteristics were measured. The results obtained are shown in Table 1 below.

For the development, a developer having the following composition was used. Developer:

| | |
|---|---|
| Hydroquinone | 45.0 g |
| N-Methyl-p-aminophenol ½ sulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Ethylenediaminetetraacetic Acid Di-sodium Salt | 1.0 g |
| Potassium Bromide | 6.0 g |
| 5-Methylbenzotriazole | 0.6 g |
| n-butyldiethanolamine | 15.0 g |
| Water to make | 1 liter |
| pH adjusted to | 11.60 |

TABLE 1

| Sample | Comparison Compound | | Compound of the Invention | | | | |
|---|---|---|---|---|---|---|---|
| No. | Kind | Amount*1 | Kind | Amount*1 | γ*2 | Dot Quality*3 | Black Pepper*4 |
| 1-1 | a | 2.5 × 10$^{-4}$ | — | — | 11 | 3 | 5 |
| 1-2 | b | 2.5 × 10$^{-4}$ | — | — | 3 | 1 | 4 |
| 1-3 | c | 1.0 × 10$^{-4}$ | — | — | 18 | 4 | 2 |
| 1-4 | — | — | 1 | 1.0 × 10$^{-4}$ | 19 | 5 | 5 |
| 1-5 | — | — | 2 | " | 20 | 5 | 5 |
| 1-6 | — | — | 5 | " | 20 | 5 | 4 |
| 1-7 | — | — | 19 | " | 17 | 5 | 5 |
| 1-8 | — | — | 24 | " | 18 | 5 | 4 |
| 1-9 | 30 | — | — | " | 19 | 5 | 3 |
| 1-10 | — | — | 44 | " | 20 | 5 | 5 |

Comparison Compound:

a

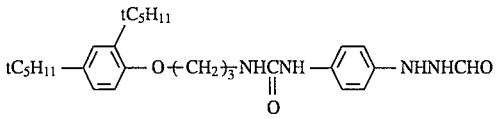

b

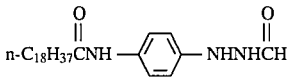

-continued

Comparison Compound:

c

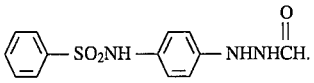

From the results shown in Table 1 above, it can be seen that the case of using each of the compounds shown by formula (I) in this invention gives high contrast and excellent dot quality with a smaller addition amount as compared to the cases of using comparison compounds a and b.

Also, in the case of using the compound of formula (I) in this invention, the occurrence of black pepper is less than the case of using comparison compound c, and the effect is more remarkable in the compound of formula (I) having a larger carbon atom number of the ballast moiety thereof.

EXAMPLE 2

Preparation of Emulsion C

A monodisperse silver chloride emulsion having a mean grain size of 0.2 μm was prepared by mixing an aqueous solution of silver nitrate and an aqueous sodium chloride solution containing 5×10$^{-6}$ mol per mol of silver of rhodium (III) hexachloride ammonium in an aqueous gelatin solution of 40° C. by a double jet method while controlling the pH at 2.3.

After the formation of silver halide grains, soluble salts were removed by a flocculation method and then 4-hydroxy-6-methyl-1,3,3a,7-tetraazaindene and 1-phenyl-5-mercaptotetrazole were added thereto as stabilizers. The amount of gelatin contained in 1 kg of the emulsion was 55 g and the amount of silver was 105 g.

To Emulsion C thus prepared were added the compound of formula (I) in this invention as shown in Table 2 below and Dye Compound C (130 mg/m$^2$) as shown below, and after further adding thereto 2,4-dichloro-6-hydroxy-1,3,5-triazine sodium salt, the silver halide emulsion thus prepared was coated on a transparent polyethylene terephthalate film support so that the silver amount became 3.5 g/m$^2$ and furthermore, a gelatin layer was formed thereon as a protective layer. Thus, Samples ( 2-1) to (2-10) were prepared.

Dye Compound C:

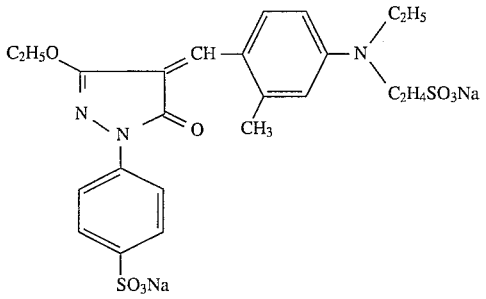

Each of the samples (photographic light-sensitive materials) was exposed through an optical wedge using P-617DQ Type printer (light source: quarts halogen lamp of 100 volts, 1 KW) made by Dainippon Screen Mfg. Co., Ltd., developed by the developer having the same formula as in Example 1 for 20 seconds at 38° C., fixed by an ordinary manner, washed, and dried.

The density of each sample thus processed was measured and the relative value of the exposure amount giving a density of 4.0 was determined.

Also, each of Samples (2-1) to (2-10) was placed under a fading preventing fluorescent lamp, FLR 40 SW-DL-X NU/W (trade name, made by Toshiba Corporation) of 200 lux as a safe light for from 0 to 60 minutes, developed by the developer having the same composition as in Example 1 for 20 seconds at 38° C., fixed, washed, and dried.

The density of each sample thus processed was measured and the limiting irradiation time at which the fog density of the same began to increase (the time increasing the fog density by 0.02 was employed as the limiting time) was determined.

The results obtained are shown in Table 2 below.

From the results shown in Table 2 above, it can be seen that Samples (2-4) to (2-10) of this invention have a sensitivity capable of making practical exposure for printing by a quartz lamp of 1KW and also are excellent in safe-light stability under a fluorescent lamp of cutting ultraviolet rays.

In particular, in the case of using the compound of formula (I) in this invention, the contrast is remarkably increased and a high layer strength is obtained for the silver halide emulsion containing a large amount of rhodium.

EXAMPLE 3

Light-sensitive elements 1 to 9 were prepared by coating, in succession, the following layers on a transparent polyethylene terephthalate film support.

(1) A mordant layer containing 3.0 g/m$^2$ of a copolymer of U.S. Pat. No. 3,898,088 having the following recurring units at the ratio shown below

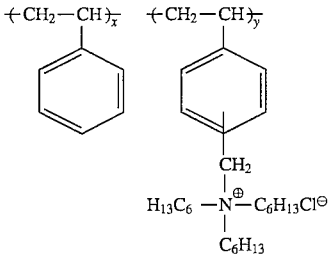

x:y = 50:50 and 3.0 g/m$^2$ of gelatin.

(2) A white reflection layer containing 20 g/m$^2$ of titanium oxide and 2.0 g/m$^2$ of gelatin.

(3) A light-shielding layer containing 2.70 g/m$^2$ of carbon black and 2.70 g/m$^2$ of gelatin.

TABLE 2

| Sample | Comparison Compound | | Compound of the Invention | | Photographic Performance | | | |
|---|---|---|---|---|---|---|---|---|
| | | | | | Relative | Safelight Irradiation | | Layer Strength*5 |
| No. | Kind | Amount*6 | Kind | Amount*3 | Sensitivity*1 | Limit Time*2 | γ*4 | (g) |
| 2-1 | — | — | — | — | 100 | 30 minutes | 4 | 155 |
| 2-1 | a | $1.0 \times 10^{-3}$ | — | — | 120 | 30 minutes | 6 | 70 |
| 2-3 | b | " | — | — | 105 | 30 minutes | 5 | 30 |
| 2-4 | — | — | 1 | $3.0 \times 10^{-4}$ | 415 | 25 minutes | 19 | 140 |
| 2-5 | — | — | 2 | " | 416 | 25 minutes | 17 | 150 |
| 2-6 | — | — | 5 | " | 417 | 25 minutes | 16 | 145 |
| 2-7 | — | — | 19 | " | 416 | 25 minutes | 18 | 142 |
| 2-8 | — | — | 24 | " | 418 | 25 minutes | 17 | 138 |
| 2-9 | — | — | 26 | " | 416 | 25 minutes | 16 | 99 |
| 2-10 | — | — | 44 | " | 414 | 25 minutes | 18 | 125 |

In Table 2:

*1Shown by the relative value of the reciprocal of the exposure amount giving a density of 4.0 with that of Sample (2-1) being defined as 100.

*2Shown by the limiting irradiation time at which the increase of the fog density in the case of allowing each sample under the fading preventing fluorescent lamp of 200 lux is within +0.02.

*3The unit was shown by mol number per mol of silver.

*4Gamma (γ) shows the gradation of the characteristic curve as the definition described in Example 1.

*5In the case of developing each sample with the developer having the same composition as in Example 1 for 20 seconds at 38° C., fixing, washing, drying, re-swelling the sample with water, pressing a styrus having a sapphire ball of 0.4 mm diameter on the surface of the layer, and continuously changing the load onto the styrus while moving the styrus at a rate of 5 mm/sec., the load (g) of breaking the layer (causing stretches) is shown as the layer strength.

*6Same as Comparison Compounds a and b in Example 1.

(4) A layer containing 0.45 g/m$^2$ of the magenta DRR compound shown below, 0.10 g/m$^2$ of diethyllaurylamide, 0.0074 g/m$^2$ of 2,5-di-t-butylhydroquinone, and 0.76 g/m$^2$ of gelatin.

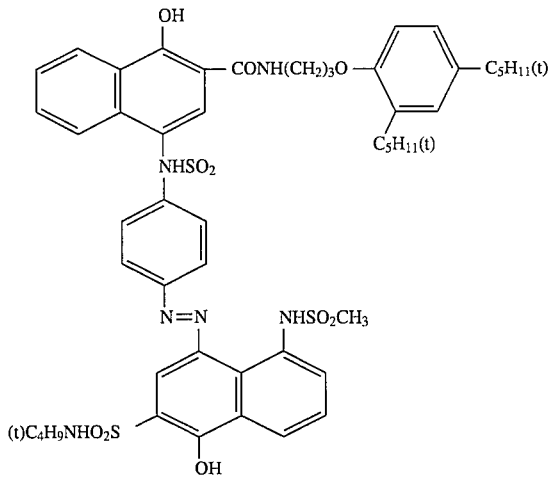

(5) A green-sensitive internal latent image type direct positive silver iodobromide emulsion (silver iodide 2 mol %) layer containing an internal latent image type emulsion (1.4 g/m$^2$ as silver), 1.9 mg/m$^2$ of the green sensitizing dye shown below, the nucleating agent as shown in Table 3 below, and 0.11 g/m$^2$ of sodium 5-pentadecylhydroquinone-2-sulfonate.

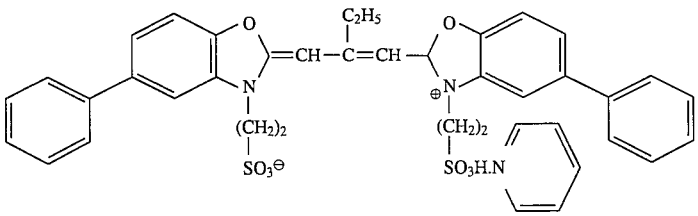

(6) A layer containing 0.94 g/m$^2$ of gelatin.

Each of aforesaid light-sensitive elements 1 to 9 was processed by combining with the following elements (processing composition and cover sheet).

Processing Composition

| | |
|---|---|
| 1-Phenyl-4-methyl-4-hydroxymethyl-3-pyrazolidine | 10 g |
| Methyl Hydroquinone | 0.18 g |
| 5-Methylbenzotriazole | 4.0 g |
| Sodium Sulfite (anhydrous) | 1.0 g |
| Carboxymethyl Cellulose Na Salt | 40.0 g |
| Carbon Black | 150 g |
| Potassium Hydroxide (28% aq. soln.) | 200 ml |
| Water | 550 ml |

The processing composition (0.8 g each) was filled in a pressure rapturable container.

Cover Sheet

A cover sheet was prepared by coating 15 g/m$^2$ of polyacrylic acid (an aqueous solution containing 10% by weight of the polymer and having a viscosity of about 1,000 c.p.) on a polyethylene terephthalate film support as an acid polymer layer (neutralization layer) and then 3.8 g/m$^2$ of acetyl cellulose (capable of forming 39.4 g of acetyl group by the hydrolysis of 100 g of the acetyl cellulose) and 0.2 g/m$^2$ of a copolymer of styrene and maleic anhydride ( styrene/maleic anhydride=about 60/40 by mol, molecular weight about 50,000) on the acid polymer layer as a neutralization timing layer.

Forcible Deterioration Condition

Two sets of light-sensitive elements 1 to 9 were prepared, one set was stored in a refrigerator (5° C.) and the other set was allowed to stand for 4 days at 35° C. and 80% in relative humidity.

Processing Step

The aforesaid cover sheet was superposed on the light-sensitive element and after exposing the light-sensitive element to a color test chart from the cover sheet side, the aforesaid processing composition was spread between both sheets at a thickness of 75 μm by the aid of pressing rollers. The processing was performed at 25° C. After one hour since processing, the green density of the images formed in the image-receiving layer (the mordant layer) was measured through the transparent sheet of the light-sensitive element by means of a Macbeth reflection densitometer.

The results obtained are shown in Table 3.

TABLE 3

| Light-Sensitive Element | Nucleating Agent Kind | Nucleating Agent Amount (mg/m$^2$) | $D_{max}^F$ | $S^F$ | $S^W$ |
|---|---|---|---|---|---|
| 1 (Comparison) | NA-1 | 0.3 | 1.85 | Unmeasurable | Unmeasurable |
| 2 (Comparison) | NA-2 | 0.7 | 0.31 | 100 | 104 |
| 3 (Invention) | 1 | " | 1.95 | 97 | 105 |
| 4 (Invention) | 2 | " | 1.93 | 99 | 104 |
| 5 (Invention) | 5 | " | 1.91 | 99 | 103 |
| 6 (Invention) | 19 | " | 1.89 | 98 | 103 |
| 7 (Invention) | 24 | " | 1.90 | 97 | 104 |

TABLE 3-continued

| Light-Sensitive Element | Nucleating Agent Kind | Nucleating Agent Amount (mg/m²) | $D_{max}^F$ | $S^F$ | $S^W$ |
|---|---|---|---|---|---|
| 8 (Invention) | 26 | " | 1.94 | 96 | 104 |
| 9 (Invention) | 44 | " | 1.91 | 98 | 103 |

In Table 3 above:
$D_{max}^F$: Maximum density of the positive image portion of the sample stored in the refrigerator.
$S^F$: Relative sensitivity of a density 0.5 of the positive image portion of the sample stored in the refrigerator (with $S^F$ of light-sensitive element 2 being defined as 100).
$S^W$: Relative sensitivity of a density 0.5 of the positive portion of the sample allowed to stand for 4 days at 35° C. and 80% RH (with $S^F$ of light-sensitive element 2 being defined as 100).

The nucleating agents used for the comparison samples are shown below.

NA-1:

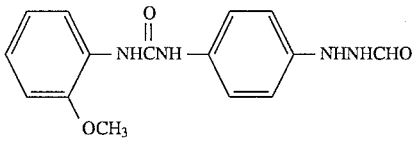

NA-2:

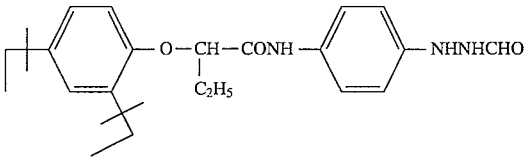

From the results shown in the above table, it can be seen that the light-sensitive elements 3 to 9 of this invention containing the nucleating agent of formula (I) in this invention readily give high Dmax as compared to the comparison samples 1 and 2 containing the aforesaid comparison nucleating agents at the same addition amount thereof and also the light-sensitive elements 3 to 9 give less change of sensitivity with the passage of time.

EXAMPLE 4

(1) Preparation of Hydrazine Compound Solution:

Solution A: Solution containing 0.8% by weight of Compound 1 in 10 wt % water-containing methanol.

Solution B: Solution containing 0.8% by weight of Compound 2 in a 10 wt % water-containing methanol.

Solution C: Solution containing 0.8% by weight of Compound 5 in a 10% water-containing methanol.

Solution D: Solution containing 0.8% by weight of Compound 19 in a 10 wt % water-containing methanol.

Solution E: Solution containing 0.8% by weight of Compound 24 in methanol.

Solution F: Solution containing 2% by weight of the comparison compound shown below in methanol.

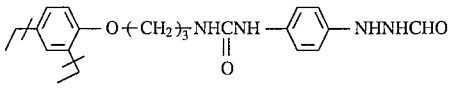

(2) Preparation of Light-Sensitive Material:

A cubic grain monodisperse silver iodobromide emulsion (silver iodide content of 2 mol %) having mean grain size of 0.3 μm was prepared and after washing and removing soluble salts by ordinary manners, the emulsion was chemically sensitized by the addition of sodium thiosulfate and potassium chloroaurate. The emulsion contained gelatin in such an amount that gelatin/silver nitrate ratio became 0.3/1 by weight.

After adding anhydro-5,5'-dichloro-9-ethyl-3,3'-bis(3-sulfopropyl)oxacarbocyanine hydroxide sodium salt as sensitizing dye and then sodium 2-(N-methyl-N-oleoylamino-)ethanesulfonate corresponding to 60 mol % of the hydrazine compound to the emulsion, each of Solutions A to E described above was mixed with the resulting emulsion so that the content of each hydrazine compound became $9.0\times10^{-4}$ mol per mol of silver, and Solution F was also mixed with the emulsion so that the amount of the comparison compound became $1.6\times10^{-3}$ mol per mol of silver. Then, after adding a dispersion of polyethylene acrylate to each emulsion, 2-hydroxy-4,6-dichloro-1,3,5-triazine sodium salt was added to each emulsion as a hardening agent immediately thereafter or after stirring the emulsion for 6 hours at 38° C., each emulsion thus prepared was coated on a polyethylene terephthalate film at a silver coverage of 3.6 g/m². In this case, a protective layer is simultaneously coated with the emulsion layer.

(3) Evaluation Method:

The sensitivity and gamma were evaluated on each sample thus prepared by a sensitometry of performing the exposure for 1 second through optical wedge.

Then, each sample was developed by the developer having the following composition for 30 seconds at 38° C., stopped, fixed, washed, and dried.

Developer

| | |
|---|---|
| Hydroquinone | 40.0 g |
| 4,4-Dimethyl-1-phenyl-3-pyrazolidone | 0.4 g |
| Sodium Hydroxide | 13.0 g |
| Anhydrous Potassium Sulfate | 90.0 g |
| Potassium Tertiary Phosphate | 74.0 g |
| Ethylenediaminetetraacetic Acid Di-sodium | 1.0 g |
| Potassium Bromide | 6.0 g |
| 5-Methylbenzotriazole | 0.6 g |
| 1-Diethylamino-2,3-dihydroxypropane | 17.0 g |
| Water to make | 1 liter |

pH adjusted to 11.5 with potassium hydroxide

The results obtained are shown in Table 4 below.

TABLE 4

| Sample No. | Additive | Addition Directly Before Coating: Sensitivity*1 | Addition Directly Before Coating: Gamma*2 | Addition 6 hours Before Coating: Sensitivity*1 | Addition 6 hours Before Coating: Gamma*2 |
|---|---|---|---|---|---|
| 4-1 | Solution A | 99 | 15.2 | 98 | 15.0 |
| 4-2 | Solution B | 98 | 14.9 | 97 | 14.8 |
| 4-3 | Solution C | 96 | 14.8 | 95 | 14.6 |
| 4-4 | Solution D | 100 | 15.3 | 98 | 15.1 |
| 4-5 | Solution E | 98 | 15.0 | 97 | 14.9 |
| 4-6 | Solution F | 100 | 10.2 | 88 | 8.8 |

*1Relative value (measured at a density of fog +0.1) with the sensitivity of Sample No. 4-6 added directly before coating defined as 100.
*2Mean gradient of the characteristic curve between the densities of 0.3 and 3.0.

From the results shown in Table 4 above, it can be seen that in Comparison Sample (4-6) containing the comparison compound, the sensitivity and gamma are greatly reduced by the passage of time of the coating composition after the addition of the compound, while the samples of this invention (Samples 4-1 to 4-5) show good sensitivity and gamma in both the cases of adding the compound of this invention to the coating composition directly before coating and of adding it 6 hours before coating. That is, it can be seen that the compounds of formula (I) in this invention are excellent in stability with the passage of time in the case of adding it to a silver halide photographic emulsion.

EXAMPLE 5

Preparation of Emulsion D

An aqueous solution of potassium bromide and sodium chloride and an aqueous solution of silver nitrate were simultaneously added to an aqueous gelatin solution containing 3,4-dimethyl-1,3-thiazoline-2-thione in an amount of 0.5 g per mol of silver with stirring vigorously at 55° C. over a period of about 5 minutes ("AgX-forming condition"), whereby a monodisperse silver chlorobromide emulsion (silver bromide content of 40 mol %) having a mean grain size of about 0.2 μm was obtained. The emulsion thus obtained was chemically sensitized by the addition of 35 mg/mol-silver of sodium thiosulfate and 20 mg/mol-silver of chloroauric acid (tetra-hydrate) followed by stirring for 60 minutes at 55° C.

Then, growth of the silver chlorobromide was carried out for 40 minutes under the same condition as the AgX-forming condition described above, to thereby provide a monodisperse core/shell silver chlorobromide emulsion having a mean grain size of 0.4 μm. The variation coefficient of the grain sizes (=standard deviation of grain size/mean grain size) was about 10%.

The emulsion obtained was chemically sensitized by the addition of 3 mg/mol-silver of sodium thiosulfate and 3.5 g/mol-silver of chloroauric acid (tetra-hydrate) followed by heating to 60° C. for 50 minutes to provide an internal latent image type silver halide emulsion (Emulsion D).

A multilayer color photographic paper having the following layer structure on a paper support having polyethylene layer on both surfaces thereof was prepared using the aforesaid core/shell type direct positive emulsion (Emulsion D).

Layer Structure

The composition of each layer was shown below, wherein the numerals are coated amounts of g per square meter. In this case, however, the coated amount of the nucleating agent is shown by mol per square meter, the amount of silver halide and the amount of colloid silver are the values (g) calculated as silver, and the amount of the. spectral sensitizing dye is shown by mol per mol of the silver halide in the same layer.

In addition, the polyethylene layer coated on the support at the emulsion carrying side contained titanium dioxide as a white pigment and ultramarine blue as a bluish dye.

Layer E1:

| | |
|---|---|
| Silver Halide Emulsion D | 0.26 |
| Spectral Sensitizing Dye ExSS-1 | $1.0 \times 10^{-4}$ |
| Spectral Sensitizing Dye ExSS-2 | $6.1 \times 10^{-5}$ |
| Gelatin | 1.11 |
| Cyan Coupler ExCC-1 | 0.21 |
| Cyan Coupler ExCC-2 | 0.26 |
| Ultraviolet Absorbent ExUV-1 | 0.17 |
| Solvent ExS-1 | 0.23 |
| Development Controlling Agent ExGC-1 | 0.02 |
| Stabilizer ExA-1 | 0.006 |
| Nucleation Accelerator ExZs-1 | $3.0 \times 10^{-4}$ |
| Nucleating Agent ExZK-1 | $3.25 \times 10^{-5}$ |

Layer E2:

| | |
|---|---|
| Gelatin | 1.41 |
| Color Mixing Preventing Agent ExKB-1 | 0.09 |
| Solvent ExS-1 | 0.10 |
| Solvent ExS-2 | 0.10 |

Layer E3:

| | |
|---|---|
| Silver Halide Emulsion D | 0.23 |
| Spectral Sensitizing Dye ExSS-3 | $3.0 \times 10^{-4}$ |
| Gelatin | 1.05 |
| Magenta Coupler ExMC-1 | 0.16 |
| Color Image Stabilizer ExSA-1 | 0.20 |
| Solvent ExS-3 | 0.25 |
| Development Controlling Agent ExGC-1 | 0.02 |
| Stabilizer ExA-1 | 0.006 |
| Nucleation Accelerator ExZS-1 | $2.7 \times 10^{-4}$ |
| Nucleating Agent ExZK-1 | $1.4 \times 10^{-5}$ |

Layer E4:

| | |
|---|---|
| Gelatin | 0.47 |
| Color Mixing Preventing Agent ExKB-1 | 0.03 |
| Solvent ExS-1 | 0.03 |
| Solvent ExS-2 | 0.03 |

Layer E5:

| | |
|---|---|
| Colloid Silver | 0.09 |
| Gelatin | 0.49 |
| Color Mixing Preventing agent ExKB-1 | 0.03 |
| Solvent ExS-1 | 0.03 |
| Solvent ExS-2 | 0.03 |

Layer E6:

Same as the cmoposition of Layer E4.

Layer E7:

| | |
|---|---|
| Silver Halide Emulsion D | 0.40 |
| Spectral Sensitizing Dye ExSS-4 | $4.2 \times 10^{-4}$ |
| Gelatin | 2.17 |
| Yellow Coupler ExYC-1 | 0.51 |
| Solvent ExS-2 | 0.20 |
| Solvent ExS-4 | 0.20 |
| Development Controlling Agent ExGC-1 | 0.06 |
| Stabilizer ExA-1 | 0.001 |
| Nucleation Accelerator ExZS-1 | $5.0 \times 10^{-4}$ |
| Nucleating Agent ExZK-1 | $2.0 \times 10^{-5}$ |

Layer E8:

| | |
|---|---|
| Gelatin | 0.54 |
| Ultraviolet Absorbent ExUV-2 | 0.21 |
| Solvent ExS-4 | 0.08 |

Layer E9:

| | |
|---|---|
| Gelatin | 1.28 |
| Acryl-Modified Copolymer of Polyvinyl Alcohol (modified degree 17%) | 0.17 |
| Liquid Paraffin | 0.03 |
| Latex Particles of Polymethylmethacrylate (mean particle size 2.8 μm) | 0.05 |

Layer B1:

| | |
|---|---|
| Gelatin | 0.05 |

Layer B2:

Same as the composition of Layer E9.

Each layer further contained gelatin hardening agent ExGK-1 and a surface active agent in addition to the aforesaid components.

These layers were laminated in the following order: E9/ES/E7/E6/E5/E4/E3/E2/E1/support/B1/B2.

The compounds used for preparing the sample were as follows.

ExCC-1: Cyan Coupler

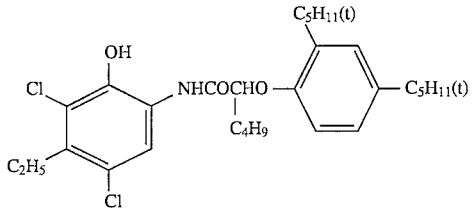

ExCC-2: Cyan Coupler

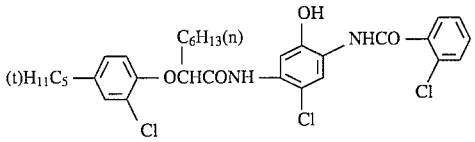

ExMC-1: Magenta Coupler

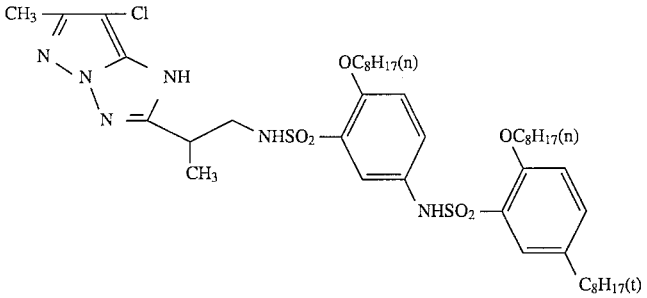

ExYC-1: Yellow Coupler

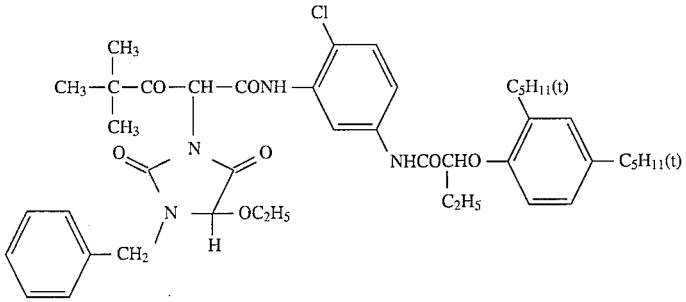

ExSS-1: Spectral Sensitizing Dye

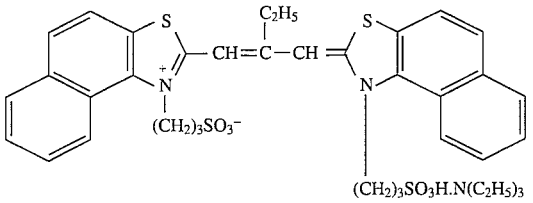

ExSS-2: Spectral Sensitizing Dye

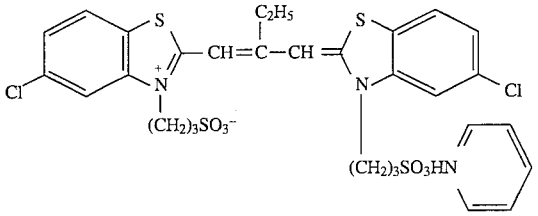

ExSS-3: Spectral Sensitizing Dye

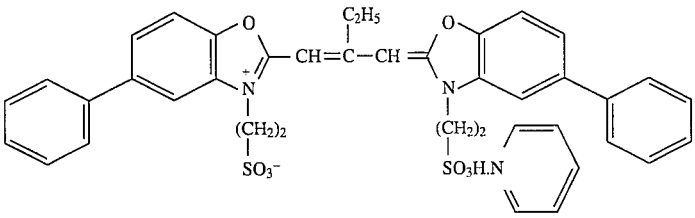

ExSS-4: Spectral Sensitizing Dye

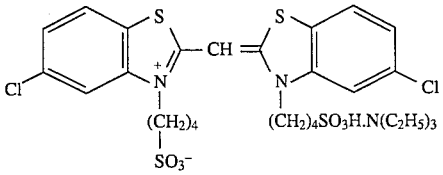

ExS-1: Solvent

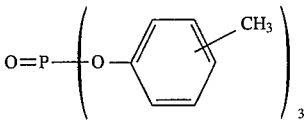

ExS-2: Solvent

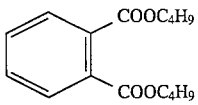

ExS-3: Solvent

Mixture of

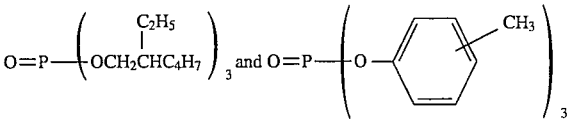

at 1:1 by volume ratio.

ExS-4: Solvent

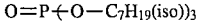

ExUV-1: Ultraviolet Absorbent

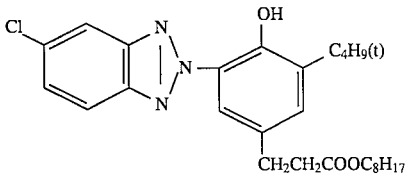

(1)

-continued

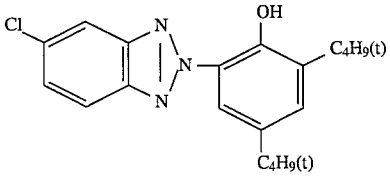

(2)

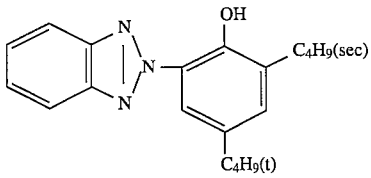

(3)

Mixture of (1):(2):(3) at 5:8:9 by weight ratio.

ExUV-2: Ultraviolet Absorbent

Mixture of (1):(2):(3) above at 2:9:8 by weight ratio.

ExSA-1: Color Image Stabilizer

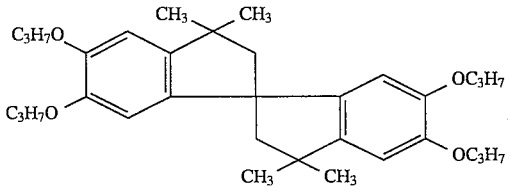

ExKB-1: Color Mixing Preventing Agent

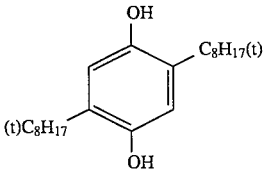

ExGC-1: Development Controlling Agent

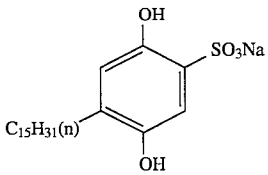

ExA-1: Stabilizer

4-Hydroxy-5,6-trimethylene-1,3,3a,7-tetraazaindene

ExZS-1: Nucleation Accelerator 2-(3-Dimethylaminopropylthio)-5-mercapto-1,3,4-thiadiazole hydrochloride ExZK-1: Nucleating agent Shown in Table 5.

ExGK-1: Gelatin Hardening Agent

1-Oxy-3,5-dichloro-s-triazine sodium salt.

After controlling the balance of the surface tension and viscosity of the coating compositions for Layers E1 to E9, they were simultaneously coated on the paper support to provide a multilayer silver halide color photographic material. Thus, the samples shown in Table 5 below were prepared.

After applying a gradation exposure for sensitometry to each sample thus prepared by means of an enlarger (Fuji Color Head 609, trade name, made by Fuji Photo Film Co., Ltd.), each sample was processed by the following steps.

Processing Step A

| | | |
|---|---|---|
| Color Development | 100 seconds | 38° C. |
| Blix | 30 seconds | 38° C. |
| Wash (1) | 30 seconds | 38° C. |
| Wash (2) | 30 seconds | 38° C. |

As the replenishing system for wash water, a countercurrent replenishing system wherein a replenisher was supplied to the wash bath (2) and the overflow liquid from the wash bath (2) was introduced into the wash bath (1) was employed.

The compositions of the processing solutions employed in the processing steps were as follows.

Color Developer Mother Liquor

| | |
|---|---|
| Diethylenetriaminepentaacetic Acid | 0.5 g |
| 1-Hydroxyethylidene-1,1-diphosphonic Acid | 0.5 g |
| Diethylene Glycol | 8.0 g |
| Benzyl Alcohol | 10.0 g |
| Sodium Bromide | 0.5 g |
| Sodium Chloride | 0.7 g |
| Sodium Sulfite | 2.0 g |
| N,N-Diethylhydroxylamine | 3.5 g |
| 3-Methyl-4-amino-N-ethyl-N-(β-methanesulfonamidoethyl)-aniline | 6.0 g |
| Potassium Carbonate | 30.0 g |
| Optical Whitening Agent (Stilbene series) | 1.0 g |
| Pure water to make | 1 liter |
| pH adjusted by potassium hydroxide or hydrochloric acid | 10.50 |

Blix Solution Mother Liquor

| | |
|---|---|
| Ammonium Thiosulfate | 110 g |
| Sodium Hydrogensulfite | 10 g |
| Ethylenediaminetetraacetic Acid Iron (III) Ammonium Dehydrate | 40 g |
| Ethylenediaminetetraacetic Acid Di-sodium Di-hydrate | 5 g |
| 2-Mercapto-1,3,4-triazole | 0.5 g |
| Pure water to make | 1 liter |
| pH adjusted to aqueous ammonia or hydrochloric acid | 7.0 |

Wash Water

Pure water was used.

In this case, pure water used was prepared by treating city water with ion-exchange resins to remove all cations except hydrogen ion and all anions except hydroxide ions to below 1 ppm.

The densities (Dmax and Dmin) of the color images thus formed were measured and the results thus obtained are shown in Table 5 below.

In addition, comparison compound a was the same as comparison compound a in Example 1.

TABLE 5

| Sample No. | Nucleating Agent (ExZK-1) | Added Layer* | Color Gradation Image Dmax | Dmin |
|---|---|---|---|---|
| 5-1 | Comparison Compound a | RSL | 1.74 | 0.31 |
| | | GSL | 1.90 | 0.22 |
| | | BSL | 1.51 | 0.27 |
| 5-2 | 1 | RSL | 2.48 | 0.21 |
| | | GSL | 2.71 | 0.16 |
| | | BSL | 2.28 | 0.19 |
| 5-3 | 2 | RSL | 2.31 | 0.24 |
| | | GSL | 2.52 | 0.14 |
| | | BSL | 2.23 | 0.19 |
| 5-4 | 5 | RSL | 2.37 | 0.23 |
| | | GSL | 2.53 | 0.16 |
| | | BSL | 2.22 | 0.18 |
| 5-5 | 19 | RSL | 2.43 | 0.21 |
| | | GSL | 2.76 | 0.18 |
| | | BSL | 2.23 | 0.19 |
| 5-6 | 24 | RSL | 2.38 | 0.21 |
| | | GSL | 2.61 | 0.17 |
| | | BSL | 2.19 | 0.19 |

*RSL: Red-Sensitive Layer
GSL: Green-Sensitive Layer
BSL: Blue-Sensitive Layer

From the results shown in Table 5 above, it can be clearly seen that the compounds of formula (I) in this invention are excellent in the function of forming color images by the combination with the direct positive silver halide emulsion as shown in Example 5 as compared with the comparison compound having a similar structure to that of the compounds of formula (I).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one light-sensitive silver halide emulsion layer formed thereon, said emulsion layer containing at least one nucleating compound represented by formula (I):

$$R_1-SO_2NH-Y-\overset{A_1}{\overset{|}{N}}-\overset{A_2}{\overset{|}{N}}-G-R_2 \quad (I)$$

wherein one of $A_1$ and $A_2$ represents a hydrogen atom and the other represents a sulfinic acid residue or an acyl group;

$R_1$ represents an aromatic group substituted by a ureido substituent or an aryloxy substituent which may each be further substituted;

$R_2$ represents a hydrogen atom, an alkyl group, an aryl group, an alkoxy group, an aryloxy group, or an amino group;

G represents a carbonyl group, a sulfonyl group, a sulfoxy group, a phosphoryl group, or an iminomethylene group; and Y represents a phenylene group or a naphthylene group; the sum of the total carbon atoms of said $R_1$, $R_2$ and Y being at least 13.

2. A silver halide photographic material comprising a support and at least one light-sensitive silver halide emulsion layer formed thereon, said emulsion layer containing at least one nucleating compound represented by formula (I):

$$R_1-SO_2NH-Y-\overset{A_1}{\overset{|}{N}}-\overset{A_2}{\overset{|}{N}}-G-R_2 \quad (I)$$

wherein $A_1$ and $A_2$ both represent hydrogen atoms or one of $A_1$ and $A_2$ represents a hydrogen atom and the other represents a sulfinic acid residue or an acyl group;

$R_1$ represents an aromatic group substituted by an alkoxy substituent, a sulfonamido substituent, a ureido substituent or an aryloxy substituent which may each be further substituted;

$R_2$ represents a hydrogen atom, an alkyl group, an aryl group, an alkoxy group, an aryloxy group, or an amino group;

G represents a carbonyl group, a sulfonyl group, a sulfoxy group, a phosphoryl group, or an iminomethylene group; and Y represents a phenylene group or a naphthylene group; the sum of the total carbon atoms of said $R_1$, $R_2$ and Y being at least 13, provided that when G represents a carbonyl group $R_2$ does not represent a hydrogen atom.

3. A silver halide photographic material comprising a support and at least one light-sensitive silver halide emulsion layer formed thereon, said emulsion layer containing at least one nucleating compound represented by formula (I):

$$R_1-SO_2NH-Y-\overset{A_1}{\overset{|}{N}}-\overset{A_2}{\overset{|}{N}}-G-R_2 \quad (I)$$

wherein $A_1$ and $A_2$ both represent hydrogen atoms or one of $A_1$ and $A_2$ represents a hydrogen atom and the other represents a sulfinic acid residue or an acyl group;

$R_1$ represents an aromatic group substituted by an acylamino substituent or an aryloxy substituent which may each be further substituted;

$R_2$ represents a hydrogen atom, an alkyl group, an aryl group, an alkoxy group, an aryloxy group, or an amino group;

G represents a carbonyl group, a sulfonyl group, a sulfoxy group, a phosphoryl group, or an iminomethylene group; and Y represents a substituted phenylene or a naphthylene group; the sum of the total carbon atoms of said $R_1$, $R_2$ and Y being at least 13.

4. A silver halide photographic material comprising a support and at least one light-sensitive silver halide emulsion layer formed thereon, said emulsion layer containing at least one nucleating compound represented by formula (I):

$$R_1-SO_2NH-Y-\overset{A_1}{\overset{|}{N}}-\overset{A_2}{\overset{|}{N}}-G-R_2 \quad (I)$$

wherein $A_1$ and $A_2$ both represent a hydrogen atom or one of $A_1$ and $A_2$ represents a hydrogen atom and the other represents a sulfinic acid residue or an acyl group;

$R_1$ represents an aromatic group substituted by a ureido substituent or a sulfamoyl substituent which may each be further substituted;

$R_2$ represents a hydrogen atom, an alkyl group, an aryl group, an alkoxy group, an aryloxy group, or an amino group;

G represents a carbonyl group, a sulfonyl group, a sulfoxy group, a phosphoryl group, or an iminomethylene group; and Y represents a phenylene group or a naphthylene group; the sum of the total carbon atoms of said $R_1$, $R_2$ and Y being at least 13.

5. A silver halide photographic material as claimed in any of claims 1–4, wherein said at least one light-sensitive silver halide emulsion layer comprises a light-sensitive silver halide emulsion which is a negative working silver halide emulsion and contains from $1\times10^{-3}$ to $5\times10^{-2}$ mol per mol of silver halide of said at least one compound represented by formula (I).

6. A silver halide photographic material as claimed in claim 5, wherein said at least one compound represented by formula (I) is contained in an amount of from $2\times10^{-5}$ to $1\times10^{-2}$mol per mol of silver halide in the emulsion.

7. A silver halide photographic material as claimed in any of claims 1–4, wherein said at least one light-sensitive silver halide emulsion layer comprises a light-sensitive silver halide emulsion which is an internal latent image type silver halide emulsion and contains from 0.005 to 500 mg per mol of silver halide of said at least one compound represented by formula (I).

8. A silver halide photographic material as claimed in claim 7, wherein said at least one compound represented by formula (I) is contained in an amount of from 0.01 to 100 mg per mol of silver halide in the emulsion.

9. A silver halide photographic material as claimed in claim 5, wherein said light-sensitive silver halide emulsion is prepared in the presence of from $10^{-8}$ to $10^{-5}$ mol per mol of silver of at least one compound selected from the group consisting of iridium salt, a complex salt of iridium, a rhodium salt and a complex salt of rhodium.

10. A silver halide photographic material as claimed in claim 7, wherein said light-sensitive silver halide emulsion is prepared in the presence of from $10^{-8}$ to $10^{-5}$ mol per mol of silver of at least one compound selected from the group consisting of iridium salt, a complex salt of iridium, a rhodium salt and a complex salt of rhodium.

11. A silver halide photographic material as claimed in any of claims 1–2, wherein $R_1$ has an aryloxy substituent.

12. A silver halide photographic material as claimed in any of claims 1–4, wherein Y is a substituent phenylene.

13. A silver halide photographic material as claimed in any of claims 1–4, wherein $R_1$ represents a substituted aromatic group having a tertiary carbon atom.

14. A silver halide photographic material as claimed in any of claims 1–3, wherein $R_1$ represents a group having a tertiary carbon atom and having an aryloxy substituent.

15. A silver halide photographic material as claimed in any of claims 1–3, wherein $R_1$ represents a group having an aryloxy substituent, wherein the aryloxy substituent has a tertiary alkyl substituent.

* * * * *